US005537972A

United States Patent [19]

Beck et al.

[11] Patent Number: 5,537,972

[45] Date of Patent: Jul. 23, 1996

[54] FUEL INJECTION SYSTEM HAVING A PRESSURE INTENSIFIER INCORPORATING AN OVERTRAVEL SAFETY FEATURE

[75] Inventors: Niels J. Beck, Bonita; James A. Peña, Leucadia; Alan R. Roach, Del Mar; Bevan H. Johnston, Spring Valley, all of Calif.

[73] Assignee: Servojet Electronics Systems, San Diego, Calif.

[21] Appl. No.: 281,931

[22] Filed: Jul. 28, 1994

[51] Int. Cl.[6] ..... F02B 77/00

[52] U.S. Cl. ..... 123/198 DB; 123/198 D; 123/446

[58] Field of Search ..... 123/446, 447, 123/198 DB, 198 D

[56] References Cited

U.S. PATENT DOCUMENTS

| | | | |
|---|---|---|---|
| 1,735,718 | 11/1929 | Attendu . | |
| 2,985,378 | 5/1961 | Falberg | 239/96 |
| 3,598,314 | 8/1971 | Bailey et al. | 239/96 |
| 4,168,804 | 9/1979 | Hofmann | 239/533.11 |
| 4,402,290 | 9/1983 | Hofer | 123/198 DB |
| 4,407,245 | 10/1983 | Eheim | 123/198 DB |
| 4,414,940 | 11/1983 | Loyd | 123/299 |
| 4,467,757 | 8/1984 | Dazzi | 123/198 DB |
| 4,544,096 | 10/1985 | Burnett | 239/92 |
| 4,605,166 | 8/1986 | Kelly | 239/96 |
| 4,628,881 | 12/1986 | Beck et al. | 123/447 |
| 4,674,688 | 6/1987 | Kanesaka | 239/533.8 |
| 4,684,067 | 8/1987 | Cotter et al. | 239/533.3 |
| 4,796,577 | 1/1989 | Baranescu | 123/300 |
| 4,825,830 | 5/1989 | Elsbett et al. | 123/300 |
| 4,903,666 | 2/1990 | Buisson et al. | 123/447 |
| 5,012,786 | 5/1991 | Voss | 123/467 |
| 5,042,445 | 8/1991 | Peters | 123/198 DB |
| 5,058,485 | 10/1991 | Cardillo | 91/485 |
| 5,191,867 | 3/1993 | Glassey | 123/446 |
| 5,241,935 | 9/1993 | Beck et al. | 123/300 |
| B1 4,715,541 | 8/1991 | Freudenschuss | 239/533.4 |

FOREIGN PATENT DOCUMENTS

| | | |
|---|---|---|
| 972143 | 1/1951 | France . |

*Primary Examiner*—Carl S. Miller
*Attorney, Agent, or Firm*—Nilles & Nilles

[57] ABSTRACT

A pressure intensified fuel injector incorporates an overtravel safety feature which prevents fuel flow through the high pressure chamber of the intensifier upon injection nozzle failure, thereby preventing further and uncontrolled injection events in the event of such failure. The overtravel safety feature is preferably formed by dimensioning the high pressure plunger of the intensifier such that, upon overtravel of the plunger in the event of injector nozzle failure, a side surface of the plunger blocks a fuel inlet port of the high pressure cylinder of the intensifier, thereby preventing further fuel flow through the high pressure cylinder. The intensifier having the overtravel safety feature can be used in either accumulator-type or non-accumulator-type injectors.

16 Claims, 14 Drawing Sheets

10
12
14
16
18
22
24
26
30
32
34
35
36
38
40
42
44
46
48
50
52
54
56
57
58
60
62
64
66
70
71
72
73
74
76
78
80
92
96
102
104
106
108
110
112
114
116
118
120
122
124
126
128
130
132
134
136
138
140
142
144
146
2
3
7

FIG. 2
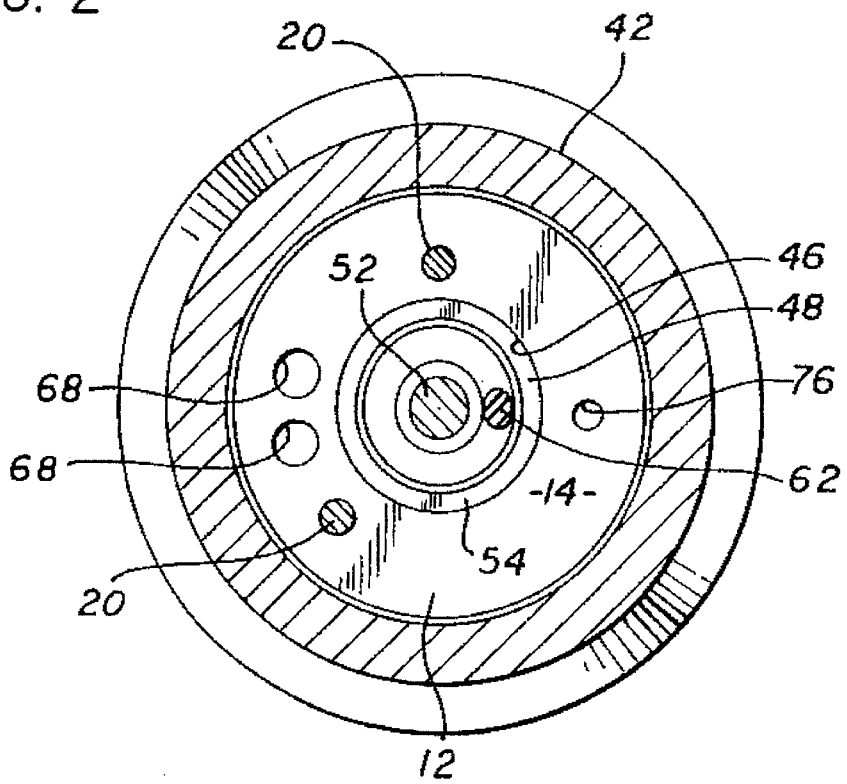
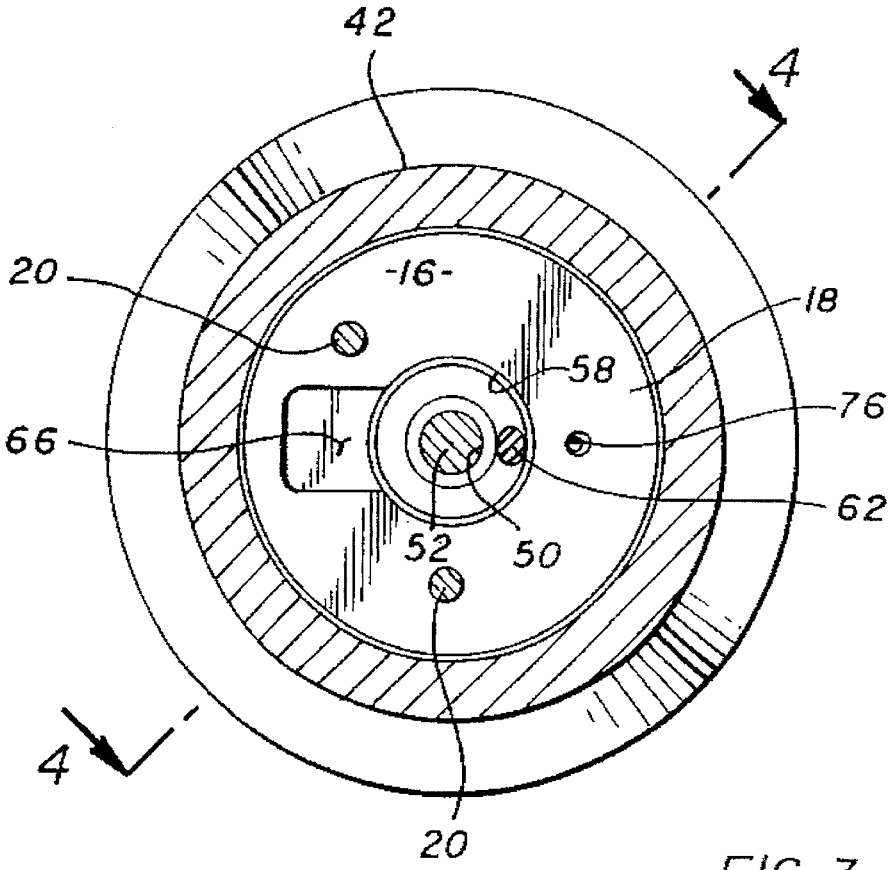
FIG. 3

FIG. 4
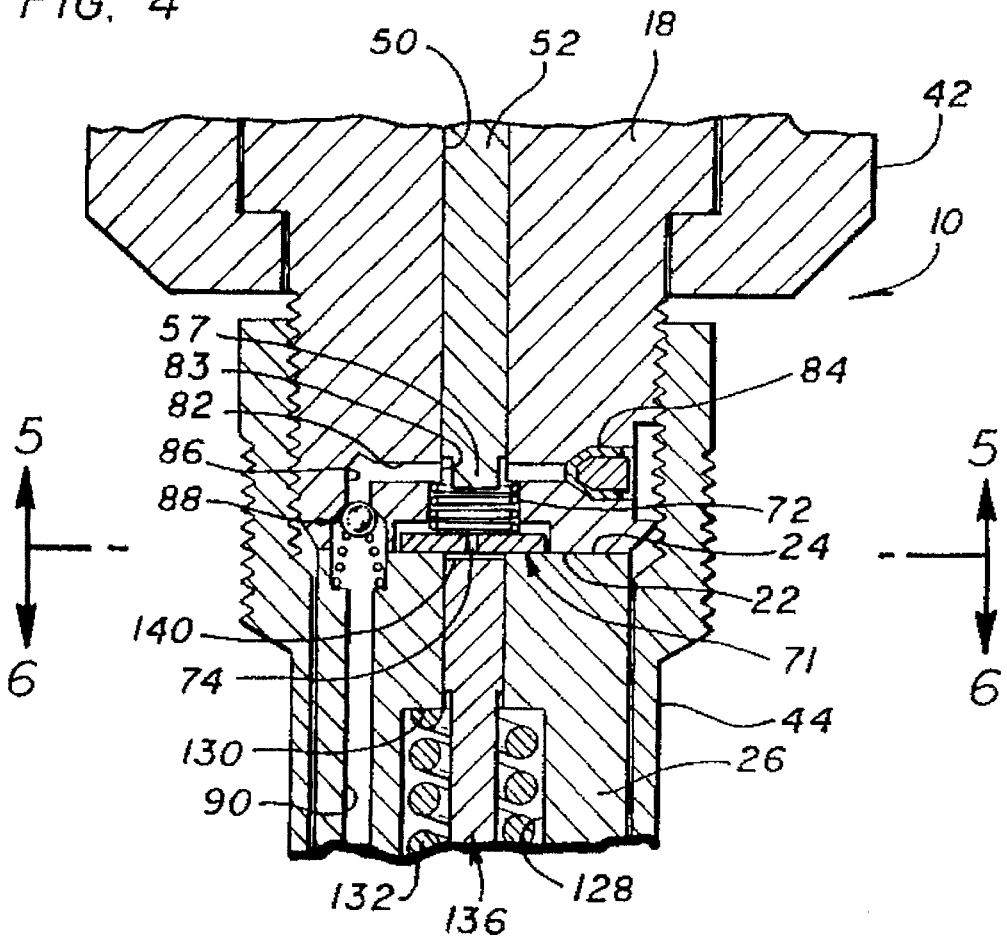
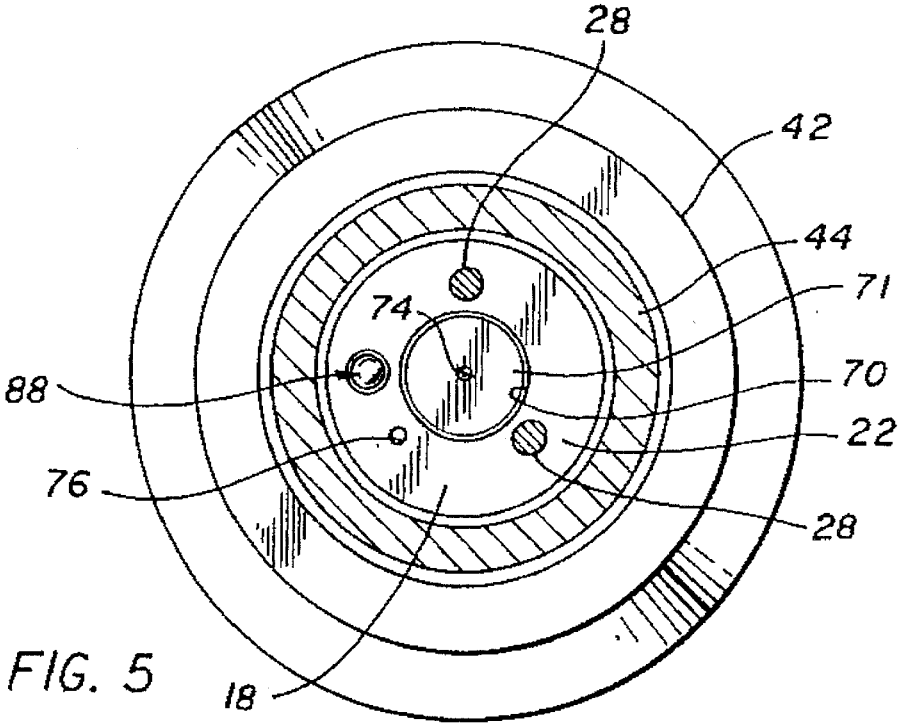
FIG. 5

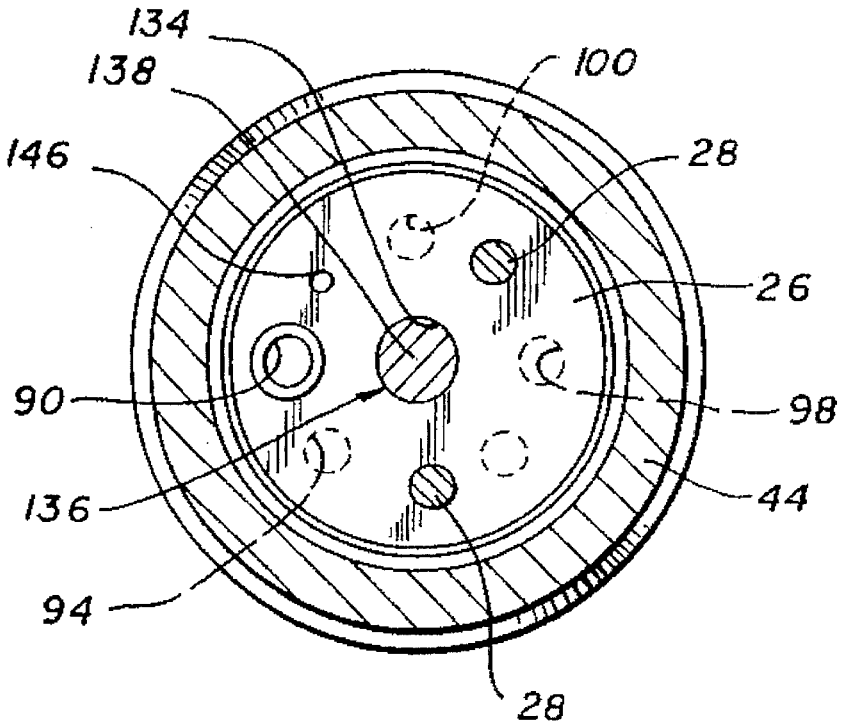
FIG. 6
FIG. 7
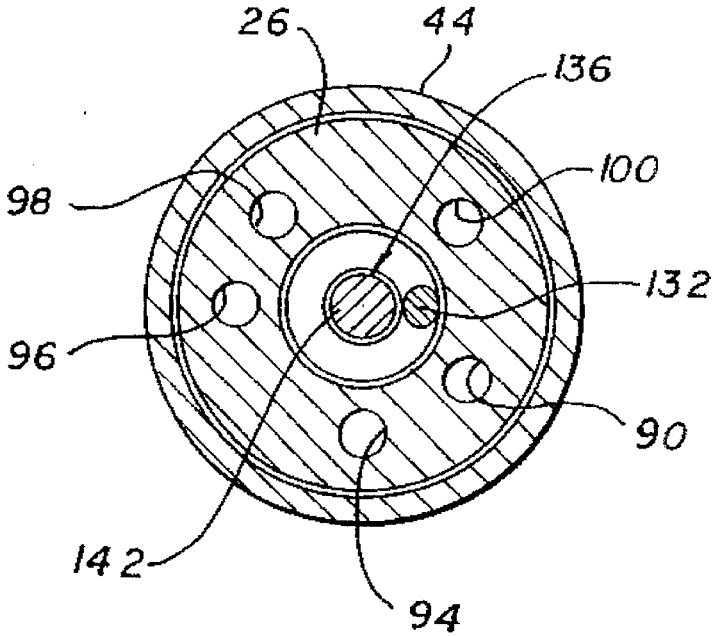

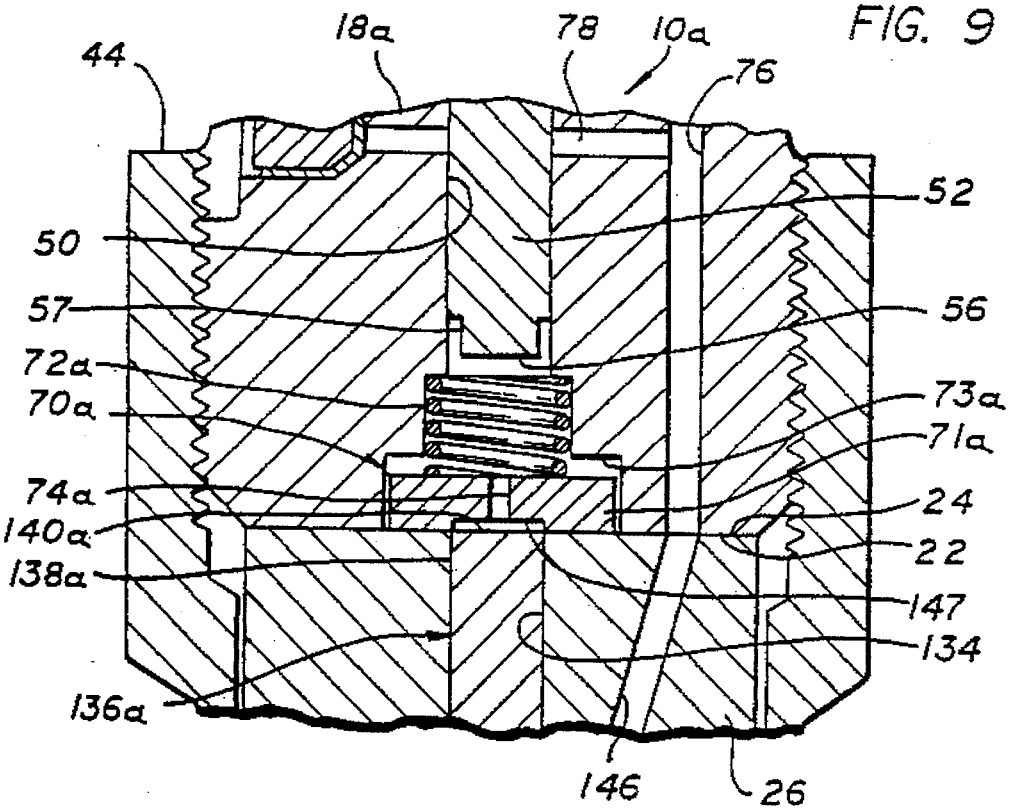
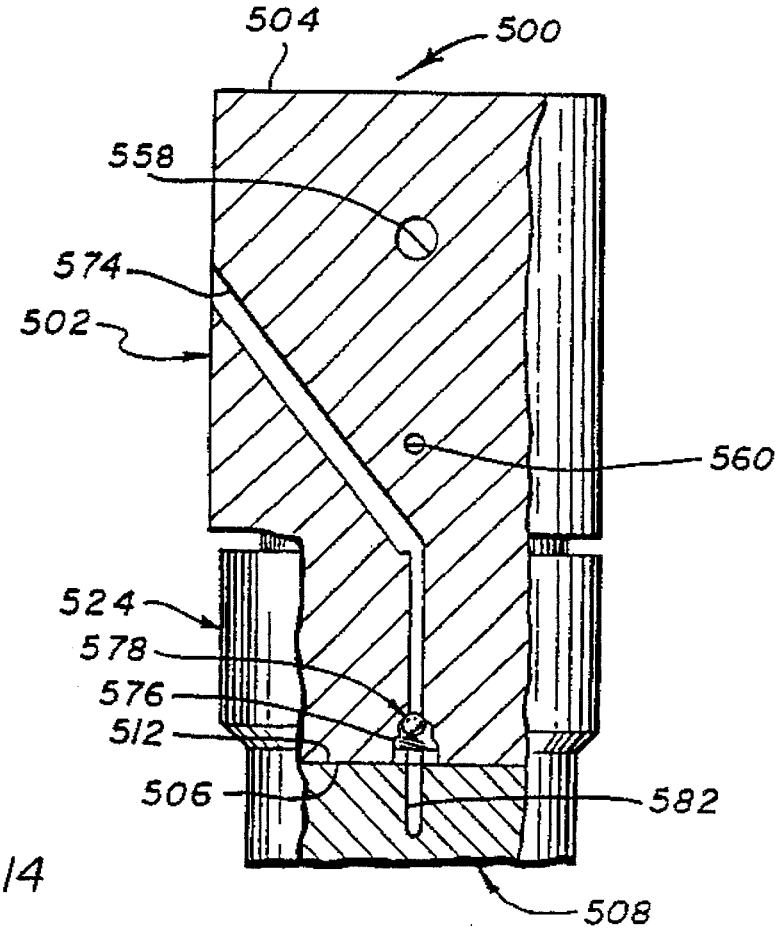
FIG. 14

FIG. 15
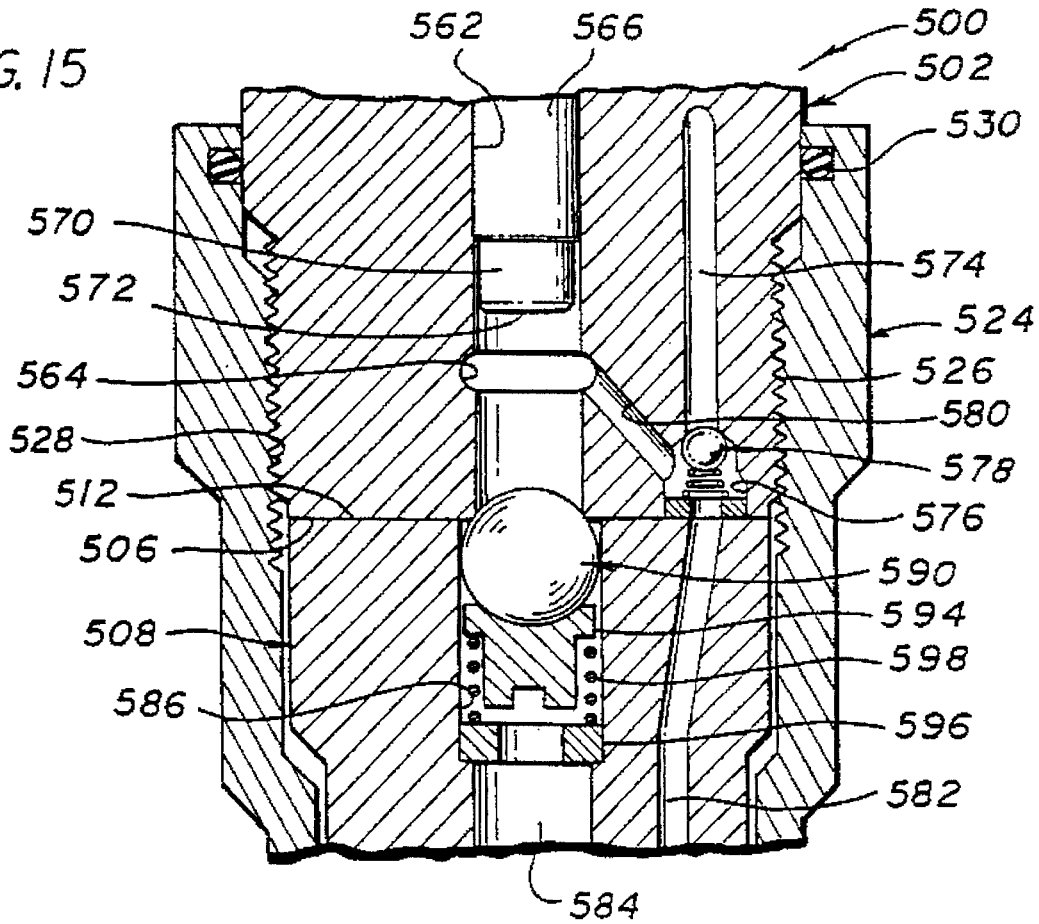
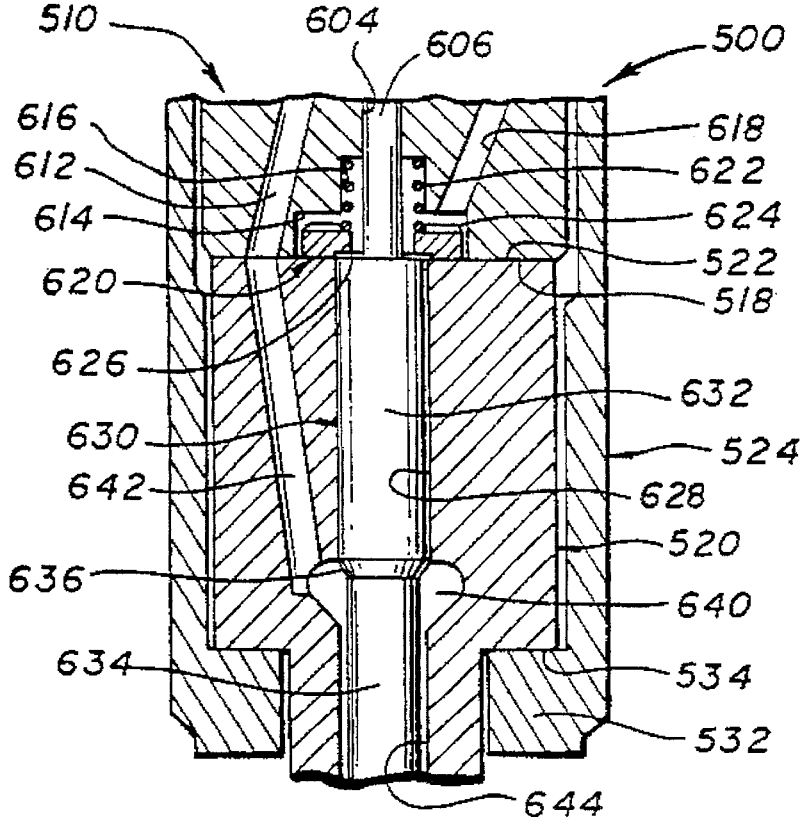
FIG. 16

FUEL INJECTION SYSTEM HAVING A PRESSURE INTENSIFIER INCORPORATING AN OVERTRAVEL SAFETY FEATURE

CROSS-REFERENCE TO RELATED APPLICATIONS

This application is a continuation of PCT/US92/05227, filed Jun. 25, 1992.

BACKGROUND OF THE INVENTION

1. Field of the Invention

The present invention relates to fuel injectors for internal combustion engines, and particularly to fuel injectors which produce improved fuel economy, noise reduction, and reduction of undesirable exhaust emissions, including smoke, oxides of nitrogen, and hydrocarbons, and which avoid further and uncontrolled injections in the event of nozzle failure.

2. Description of the Prior Art

Accumulator-type fuel injectors have been known in the art for many years, but never have achieved widespread use. It is believed this is because they have heretofore not solved problems present in conventional injectors, and have even introduced additional problems which have been inherent in prior art forms of accumulator injectors.

One serious problem with both conventional fuel injectors and prior art accumulator-type fuel injectors has been premixed burning of the fuel. Typically, about 25–50 percent of the total quantity of fuel injected will be atomized and mixed with air prior to the start of combustion. The sudden combustion of this premixed fuel causes a rapid rate of heat release at the beginning of ignition, with a resulting excessively high noise level, and undesirable exhaust emissions including oxides of nitrogen. One answer to this problem is to provide a two-stage injection event, with a small pilot charge of fuel first injected and ignited, and then the main charge of fuel injected and immediately ignited by the already ignited pilot charge. A system of this type is taught in Loyd U.S. Pat. No. 4,414,940. Although the Loyd system does solve the problem, it requires two separate injectors, one for the pilot charge and another for the main charge, making the system undesirably complicated and expensive.

Intensified fuel injectors typically rely on a balancing of pressures in the high pressure chamber and accumulator chamber or other chamber supplied with fuel from the high pressure chamber to terminate an intensification stroke. However, in the event of injector nozzle breakage, cracking or other failure, the balancing pressure may be relieved from the accumulator chamber or other downstream chamber since the injector needle cannot effectively close off the nozzle, and fuel can continue to flow into the needle cavity from the high pressure chamber, and thence out through the breach. Without a safety feature to prevent further flow of fuel through the high pressure chamber, the result could be a series of further and uncontrolled injection events.

SUMMARY OF THE INVENTION

In view of these and other problems in the art, it is a general object of the present invention to provide a fuel injector for internal combustion engines which produces reduced noise levels, and reduction of undesirable exhaust emissions including oxides of nitrogen.

Another object of the invention is to provide an improved fuel injector for internal combustion engines which substantially eliminates sudden premixed burning and its adverse effects of noise and undesirable exhaust emissions.

Another object of the invention is to provide a simplified two-stage injection system for first injecting a small pilot or initial charge of fuel which is ignited before injection of the main charge, and then injecting the main charge of fuel which is immediately ignited by the already ignited pilot charge, for elimination of the usual large amount of premixed burning and its adverse effects, the system requiring only a single injector.

Yet a further object of the invention is to provide, in an intensified accumulator-type fuel injector, intensifier plunger over-travel safety means for stopping further and uncontrolled injection events in the event of injector nozzle failure.

The present invention provides a series of both method and apparatus advances in the accumulator-type fuel injector art, each of which produces improved engine performance, and when some or all are combined, synergistically produce surprisingly large improvements in noise reduction and reduction of undesirable exhaust emissions including oxides of nitrogen. The invention is particularly applicable to intensified accumulator injectors of the general type disclosed in U.S. Pat. No. 4,628,881 to Beck et al. (the Beck et al. '881 patent).

Preferred forms of the present invention embody a two-stage needle lift for first injecting a small pilot or initial charge of fuel which is ignited before injection of the main charge, and then injecting the main charge of fuel which is immediately ignited by the already ignited pilot charge. This eliminates the usual amount of premixed burning and its adverse effects of poor fuel economy, large noise levels, and large levels of undesirable exhaust emissions. The initial needle prelift or low-lift stage may be from about 1 to about 20 percent of maximum needle lift, and the initial or pilot charge is preferably on the order of about 2–20 percent of the full charge.

A further feature of the invention is the provision of an overtravel safety feature which prevents further flow of fuel through the high pressure chamber of the intensifier upon injection nozzle breakage, cracking or other failure, thereby preventing further and uncontrolled injection events in the event of such failure.

BRIEF DESCRIPTION OF THE DRAWINGS

These and other objects and advantages of the invention will become more apparent from the following Detailed Description and the accompanying drawings, wherein:

FIG. 2 is a traverse section taken on line 2—2 of FIG. 1, looking upwardly;

FIG. 3 is a traverse section taken on line 3—3 of FIG. 1, looking downwardly;

FIG. 4 is a fragmentary longitudinal section, partly in elevation, taken on line 4—4 of FIG. 3;

FIG. 5 is a traverse section taken on line 5—5 of FIG. 4, looking upwardly;

FIG. 6 is a traverse section taken on line 6—6 of FIG. 5, looking downwardly;

FIG. 7 is a traverse section taken on line 7 of FIG. 1;

FIG. 9 is a view similar to a portion of FIG. 8 showing a second form of the stop plate or wafer;

FIG. 14 is a further enlarged, fragmentary longitudinal section taken on line 14—14 of FIG. 13;

FIG. 15 is a further enlarged, fragmentary longitudinal axial section taken in the bracketed region 15 of FIG. 13;

FIG. 16 is a view similar to FIG. 15 taken in the bracketed region 16 of FIG. 13;

DETAILED DESCRIPTION

A. First Embodiment

Figure 1:
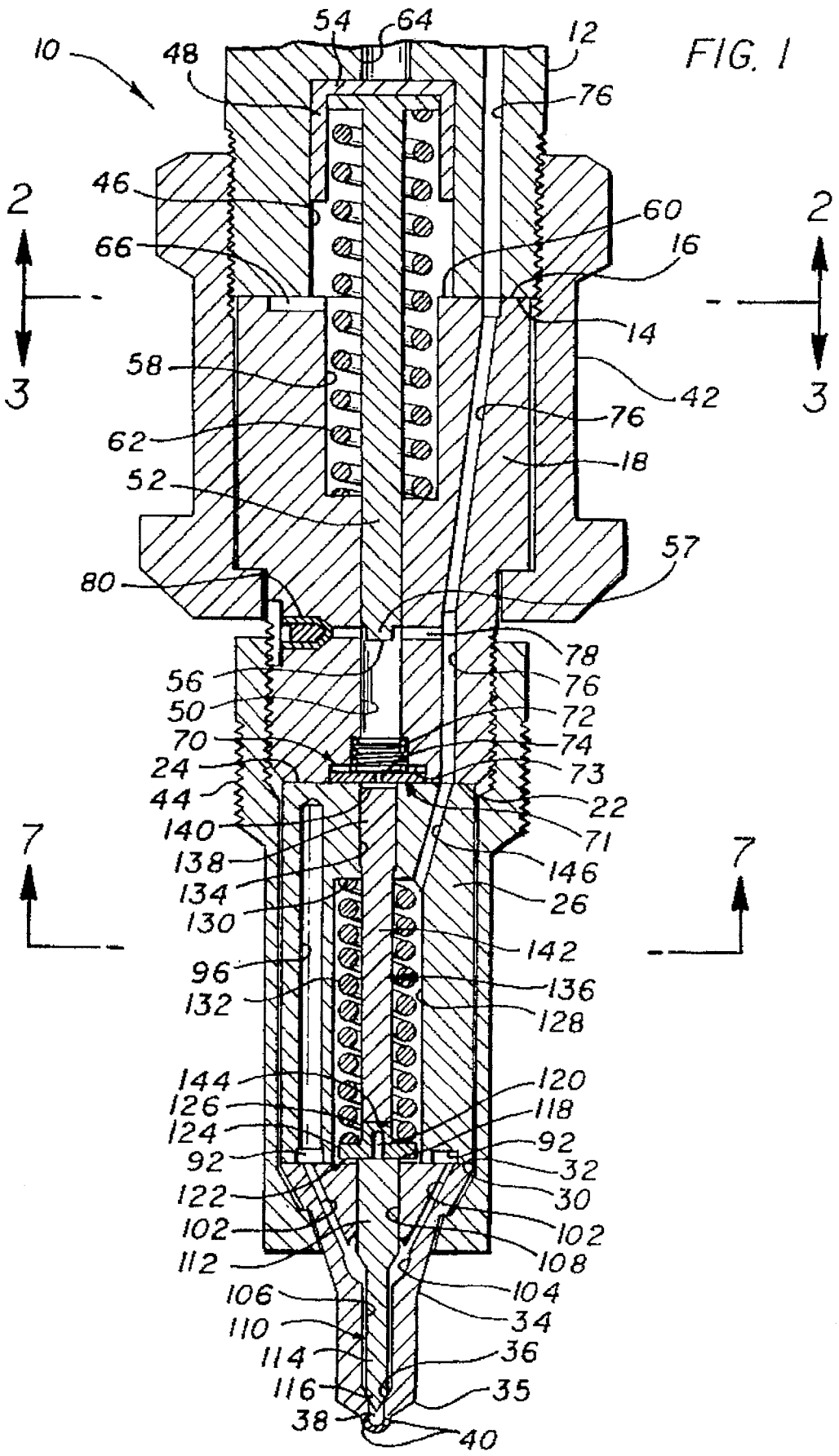
FIG. 1 is an enlarged longitudinal, axial sectional view of an intensified form of the present invention, with the needle shown in the closed position.

Referring to the drawings, and at first particularly to FIGS. 1–8 thereof, these figures illustrate an "intensified" or pressure multiplied fuel injector 10. The longitudinal axial sectional view of FIG. 1 best illustrates the overall assembly, while the fragmentary longitudinal axial section of FIG. 4 best illustrates the high pressure fuel input to the accumulator cavity.

The intensified fuel injector has particular utility for diesel engines where high overall accumulator pressures and consequent high closing pressure enabled thereby can be beneficial as described hereinafter. Nevertheless, it is to be understood that intensified injectors may also be beneficially employed for engines powered with gasoline or other liquid fuels.

1. Construction of First Embodiment

The intensifier-type accumulator injector of the invention is generally designated 10. A control block 12 is disposed at the upper end of injector 10, control block 12 being in communication with a high speed solenoid actuated control valve (not shown). Such control valve may be like the valve 30 shown and described in detail in the Beck et al. '881 patent, which is best illustrated in FIGS. *5a*, 9 and 10 of that patent. Features which it is desirable to incorporate in the high speed solenoid actuated control valve are covered in jointly owned co-pending applications, Ser. No. 823,807 of Robert L. Barkhimer, filed Jan. 29, 1986 for High Cycle Solenoid Valve (now U.S. Pat. No. 4,997,004), and Ser. No. 830,000 of Niels J. Beck, filed Feb. 18, 1986 for Ball Poppet Valve Seat Construction.

Control block 12 is hydraulically connected to such solenoid actuated control valve in a manner similar to the hydraulic connections of the block 110 to the valve 30 in said Beck et al. '881 patent, for an overall mode of operation of the present intensified accumulator injector 10 which is essentially the same as that of the injector of FIGS. *5a*, *5b*, 9 and 10 of the Beck et al. '881 patent. It is to be noted that in the Beck et al. '881 patent the block 110 serves not only as the upper part of the injector but also as the main body of the valve, whereas control block 12 in the present invention may be attached to an independent valve body or otherwise hydraulically connected to the solenoid actuated valve, remotely if desired.

The flat, transverse lower end surface 14 of control block 12 is lapped to a mating flat, transverse upper end surface 16 of an intensifier body 18, control block 12 and intensifier body 18 being keyed together for correct relative orientation by a pair of locator dowers 20 which are seen in FIGS. 2 and 3. The flat, transverse lower end surface 22 of intensifier body 18 is, in turn, lapped to a flat, transverse upper end surface 24 of an accumulator body 26, intensifier body 18 and accumulator body 26 being keyed together in correct relative orientation by a pair of locator dowels 28 seen in FIGS. 5 and 6. The flat, transverse lower end surface 30 of accumulator body 26 is lapped to a flat, transverse upper end surface 32 of a nozzle body 34 which extends from upper end surface 32 to a lower end generally designated 35 and which, in the illustrated embodiment is a sac nozzle in the lower end 35 of the nozzle body 34 of which are the injector valve seat 36, sac 38 and injection holes 40.

The control block 12 and intensifier body 18 are clamped together within an upper housing 42, intensifier body 18 being stepped so as to seat within upper housing 42, and control block 12 being threadedly coupled to upper housing 42. The accumulator body 26 and nozzle body 34 are clamped together with a lower housing 44 which is threadedly coupled to intensifier body 18.

A low pressure hydraulic cylinder 46 having a relatively large diameter bore is axially defined within control block 12, and a relatively large diameter, down-cupped low pressure piston 48 is axially slidable within cylinder 46. A coaxial high pressure hydraulic cylinder 50 having a relatively small bore is axially defined within intensifier body 18, extending down through the lower end surface 22 of intensifier body 18. A high pressure piston or plunger 52 having a relatively small diameter is axially slidable within high pressure cylinder 50. High pressure piston 52 has an upper end cap 54, shown as a flange, which seats inside the low pressure piston 48 against the top wall of the latter. High pressure piston 52 extends downwardly to a flat, transverse lower end 56, and has a reduced diameter lower end portion 57. A cylindrical spring cavity 58 is defined within intensifier body 18, opening through the upper end surface 16 of body 18 into communication with low pressure cylinder 46. Spring cavity 58 is coaxial with cylinder 46 but of smaller diameter so as to provide an upwardly facing shoulder 60 which acts as a stop for downward movement of low pressure piston 48, and consequently also high pressure piston 52 which moves axially down and up as a unit with low pressure piston 48. A piston return spring 62 is disposed within both low pressure cylinder 46 and spring cavity 58, having its lower end seated against the bottom of cavity 58 and its upper end seated against high pressure piston flange 54, biasing flange 54 against the top of low pressure piston 48 so as to effectively couple the pistons 48 and 52 together at all times.

An actuating fluid inlet and vent passage 64 extends axially through the upper portion of control block 12 into communication with low pressure cylinder 46, and provides liquid into low pressure cylinder 46 to drive low pressure piston 48, and hence also high pressure piston 52, downwardly in an intensification stroke from the uppermost position of the two pistons as illustrated in FIG. 1 downwardly to an extent determined by the momentary power demand of the engine, the lowermost positions of the pistons being determined by engagement of the lower lip of low pressure piston 48 against stop shoulder 60. The liquid supplied via passage 64 preferably comprises fuel but, as discussed in the Beck '881 patent, could comprise engine lube oil or the like. The Beck et al. '881 patent is, as discussed below, incorporated herein by reference. The lowermost position of high pressure piston 52 is the position illustrated in FIG. 4.

Inlet/vent passage 64 also serves as a vent passage through which fluid is vented from low pressure cylinder 46 for initiating and controlling the timing of a small incremental prelift of the needle for injection of a small initial or pilot charge, and then full lift of the needle for the main injection. Inlet/vent passage 64 preferably has variable orificing (not shown) for controlling the rate of decay of pressure in low pressure cylinder 46, and hence of the intensified pressure in high pressure cylinder 50, for adjustment of the timing of the prelift and full lift events, as described in detail hereinafter in the description of the operation of the intensified injector 10. The time duration of the prelift phase of the injection event will control the quantity of the pilot charge. Such variable venting by variable orificing or valving of passage 64 affords the opportunity to adjust the prelift portion of the injection while the engine is running by dynamic adjustment of the vent fluid flow. The rate of decay of pressure in low pressure cylinder 46, and hence of the intensified pressure in high pressure cylinder 50, may also be controlled by adjusting the pressure level in the vent line to passage 64, and this may also be done while the engine is running.

To accomplish a downward intensification stroke of pistons 48 and 52, pressurized liquid is passed through inlet/vent passage 64 from the solenoid control valve referred to above at common rail pressure (i.e., regulated pump pressure). For time interval (or time duration or pulse width) fuel metering of the amount of the fuel charge to be introduced into the accumulator, this rail pressure will be the same for each piston stroke, typically on the order of about 1,500 psig, but the length of the time interval during which pressurized fuel is supplied to low pressure cylinder 46 through inlet/vent passage 64 will vary from a relatively short time interval for low engine power to a relatively long time interval for high engine power. For pressure compressibility fuel metering of the fuel charge to be introduced into the accumulator, the pressure of liquid introduced into low pressure cylinder 46 through inlet/vent passage 64 will vary according to engine power demands, as for example from about 500 psig at idle to about 1,500 psig at full power.

For either such time duration fuel metering or pressure compressibility fuel metering, or a combination of both, the length of the downward intensification stroke of pistons 48 and 52 will vary according to power demand, the stroke being a relatively short stroke for a relatively low power demand, and a relatively long stroke for a relatively high power demand, with the full power, maximum stroke length being to the high pressure piston 52 position shown in dotted lines in FIG. 1 and shown in FIG. 4. The hydraulic pressure which builds up in low pressure cylinder 46 will be generally proportional to the length of the downward stroke, and the intensified pressure in high pressure cylinder 50 will be higher than the low pressure cylinder pressure in proportion to the cross-sectional area of high pressure piston 48 divided by the cross-sectional area of low pressure piston 52. A satisfactory intensification factor is on the order of about 15:1, produced by a 15:1 area ratio of low pressure piston 48 to high pressure piston 52. For example, with such a 15:1 intensification, a relatively low rail pressure of 500 psig would produce a relatively low engine power intensified pressure of 7,500 psig, while a relatively high rail pressure of 1,500 psig would produce a relatively high engine power intensified pressure of 22,500 psig.

At the engine-timed instant for initiation of an injection event, the solenoid valve shifts to a vent position in which it vents passage 64, and hence low pressure cylinder 46, to a lowered pressure, which may be essentially atmospheric pressure, which enables piston return spring 62 to move both of the pistons 48 and 52 back up to their positions of repose as illustrated in FIG. 1. The manner in which this causes the injection event to occur will be described in detail hereinbelow.

Pressure relief from within cylinder 46 and spring cavity 58 during the intensification downstroke of the pistons is accomplished through a vent cavity 66 in the upper end of intensifier body 18 and a pair of communicating vent passages 68, seen in FIG. 2, which extend longitudinally upwardly through control block 12 and are vented to essentially atmospheric pressure.

Figure 8:
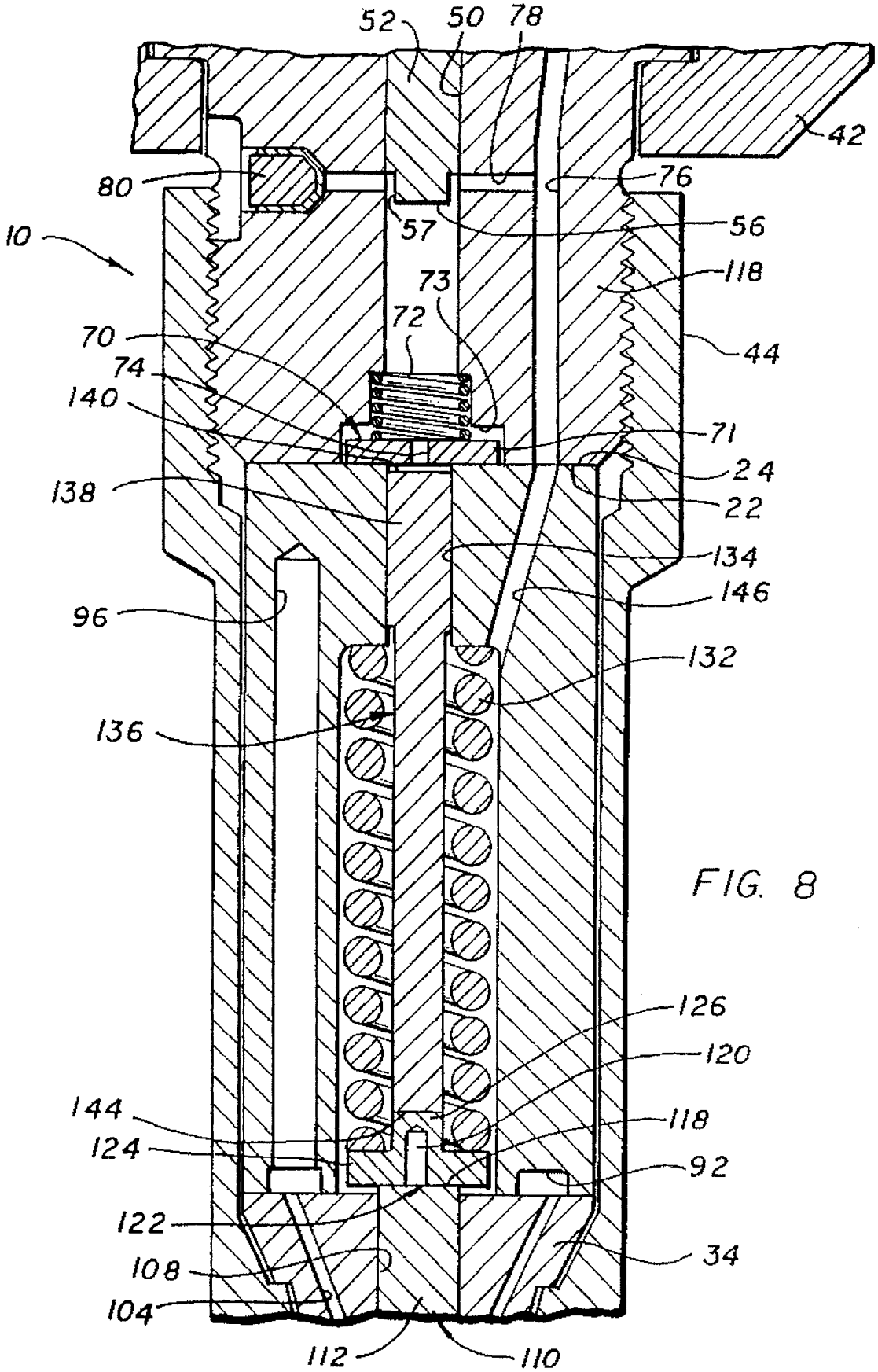
FIG. 8 is a further enlarged fragmentary longitudinal, axial section of a portion of FIG. 1, showing a first form of the opening stop plate or wafer of the invention which is employed to provide two-stage needle lift.

A stepped counterbore is provided in the lower end of high pressure cylinder 50. The relatively large diameter lower portion of this stepped counterbore defines a damper cavity 70 in which a needle stop plate member 71 is disposed. The relatively small upper portion of this stepped counterbore provides a guide for a plate spring 72 which engages the top of plate 71 and biases plate 71 to a normally seated position as shown in FIGS. 1 and 8 with its lower surface 71' peripherally seated flush against the upper end surface 24 of accumulator body 26. The lower surface 71' of plate 71 has a lapped (sealingly seated) fit against a shoulder formed by upper body surface 24 so as to provide a fluid-tight seal in the normally seated position of plate 71. As a result, the net fluid pressure on the plate 71 is the product of 1) the interface area, and 2) the difference between the ambient pressure in cavity 70 and the vapor fluid pressure. Plate 71 is sometimes referred to herein as a needle stop because it serves the function of stopping the opening stroke of the injector needle by abutting against the step or shoulder 73 between the two sections of the stepped counterbore to define the fully open position of the needle. Plate 71 performs two other important functions which will be described in more detail hereinafter. First, whilst still in its seated position as shown in FIG. 1, at the beginning of the opening stroke, the seated plate 71 enables the needle to open slightly to a prelift or low-lift position but stops the needle in this slightly open position for injection of a small initial or pilot charge; and then after a brief interval of time allows the needle to proceed to its fully open position for injection of the main fuel charge. Plate 71 has a central hole 74 therethrough for admitting intensified pressurized fuel to the region below plate 71 during the intensification stroke and until initiation of injection, for holding the needle column down against the intensified pressure within the accumulator cavity. Second, plate 71 serves as a hydraulic damper for damping the end of the opening stroke of the needle to prevent needle bounce for a more uniform fuel spray in the early part of the injection event. The opening damping effect can be adjusted by adjusting the radial clearance between the periphery of stop plate 71 and the annular surface of damper cavity 70.

A fluid supply conduit 76 continuously supplies fuel to the injector 10 at rail pressure, extending longitudinally down through both control block 12 and intensifier body 18, opening downwardly through the lower end surface 22 of intensifier body 18. Fuel supply conduit 76 supplies fuel to high pressure cylinder 50 for intensification and valving on into the accumulator cavity. A cross-conduit 78 provides communication from fuel supply conduit 76 to high pressure cylinder 50, the other end of cross-conduit 78 being blocked by a high pressure plug 80, such as a "Lee Plug," disposed in a counterbore of the cross-conduit 78.

After the end of each intensification stroke during which high pressure piston 52 has delivered highly pressurized and compressed fuel from high pressure cylinder 50 into the accumulator cavity, when high pressure piston 52 moves back upwardly to its uppermost, rest position as shown in FIG. 1, it draws a vacuum in high pressure cylinder 50 below fuel inlet cross-conduit 78. When the lower end portion 57 of high pressure piston 52 uncovers cross-conduit 78 into communication with high pressure cylinder 50, fuel under rail pressure from supply conduit 76 flows through cross-conduit 78 to fill the void in the lower portion of high pressure cylinder 50.

High pressure cylinder 50 is thus loaded with fuel at rail pressure and is ready for another intensification stroke during which it greatly increases the fuel pressure above rail pressure, compressing the fuel and delivering it to the accumulator cavity. For time interval fuel metering, the amount of increase of pressurization within high pressure cylinder 50 over rail pressure will be determined by the duration of the time interval, and the corresponding length of the stroke of high pressure piston 52 downwardly from its rest position as shown in FIG. 1. For pressure compression metering, the pressure produced by the intensification stroke in high pressure cylinder 50 will be an increase above rail pressure in proportion to the ratio of the transverse area of low pressure piston 48 to the transverse area of high pressure piston 52, since the intensification stroke is timed to enable a substantial equilibrium to be achieved between the downward rail pressure force against the top of low pressure piston 48 and upward intensified fluid pressure force against the lower end 56 of high pressure piston 52, before the injection event is commenced by venting fluid pressure from above low pressure piston 48 through inlet vent passage 64.

Reference will now be made to FIG. 4 which illustrates the fluid communication from high pressure cylinder 50 into the accumulator cavity. The axial sectional view of FIG. 4 is rotationally offset 135° from the axial section of FIG. 1, this 135° offset being clockwise looking downwardly as in FIGS. 3 and 6. A second radially oriented cross-conduit 82 is located below the upper end of the reduced diameter lower end portion 57 of high pressure piston 52 at the lowermost stroke position of high pressure piston 52 as illustrated in FIG. 4. Cross-conduit 82 defines an outlet port 83 from high pressure cylinder 50 leading to the accumulator cavity. High pressure plug 84, such as a Lee Plug, seals the drilling end of cross-conduit 82, being located in a counterbore thereof.

Cross-conduit 82 leads from outlet port 83 to a longitudinally oriented passage 86 which provides communication from high pressure cylinder 50 through a check valve 88 leading to an accumulator bore 90 which defines one portion of the overall accumulator cavity. Accumulator bore 90 is located generally in the peripheral region of accumulator body 26, and is oriented parallel to the longitudinal axis of accumulator body 26. Accumulator bore 90 extends downwardly to a location proximate the bottom of accumulator body 26 where it communicates with an annular cavity or ring passage 92 seen in FIG. 1, in the same manner as accumulator bore 96 shown in FIG. 1. There are five of these longitudinally arranged accumulator bores spaced about the peripheral region of accumulator body 26 in the form of the invention illustrated in FIGS. 1–12 which cumulatively make up the primary accumulator cavity, all of which communicate with annular cavity 92. These are seen in section in FIG. 7, and in the transverse sectional view of FIG. 6 the accumulator bore 90 is seen from its upper end and the four other accumulator bores 94, 96, 98 and 100 are shown in dotted lines.

While five of these accumulator bores make up the primary accumulator cavity in the illustrated form of the invention, it is to be understood that any desired number of such accumulator bores having any desired diameter may be provided according to the selected volume for the primary accumulator cavity of injector 10. Not only can the number and diameters of these accumulator bores be varied, but also the lengths of all these accumulator bores except inlet bore 90 can be varied to provide the desired primary accumulator cavity volume.

A feature of this form of the present invention is the fact that the entire accumulator cavity including the primary cavity represented by accumulator bores 90, 94, 96, 98 and 100, and annular cavity 92 are completely isolated from and independent of the injector needle spring cavity, while nevertheless being compactly arranged closely proximate the spring cavity within a lower portion of the injector, namely within accumulator body 26, and thus structurally completely separated from and independent of the upper intensifier portion of the injector. In a high pressure injector such as in the intensified injector 10, the spring cavity must be relatively large to accommodate a relatively large needle closure spring. Separation of the accumulator cavity from the spring cavity enables the overall accumulator cavity to be much smaller than conventional accumulator cavities which include the spring cavity, for very high pressure operation of the injector 10. This feature is most useful in small injectors.

As seen in FIG. 1, annular cavity or ring passage 92 communicates through a plurality of small diameter passages 102 in nozzle body 34, preferably three or four in number, to a small kidney cavity 104 in nozzle body 34 which in turn communicates with needle cavity 106 that leads to valve seat 36. The small kidney cavity 104 and needle cavity 106 together provide a small secondary accumulator cavity from which the aforesaid small initial or pilot charge is initially injected into the engine cylinder at the onset of the injection event prior to injection of the main fuel charge from the primary accumulator cavity defined in accumulator bores 90, 94, 96, 98 and 100, and annular cavity or ring passage 92. Such pilot charge is preferably about 2–20 percent of the total injected fuel charge, and most preferably about 5–10 percent of the total charge.

A cylindrical needle guide passage 108 is axially defined within nozzle body 34 between its upper and surface 32 and kidney cavity 104. Injector valve needle 110 has an upper guide position 112 which axially slidably and sealingly fits within guide passage 108. The upper guide portion 112 of needle 110 is of relatively large diameter, and below it needle 110 tapers down in the region of kidney cavity 104 to a relatively small diameter lower shank portion 114 which terminates at conical needle tip 116. The sliding fit of upper needle guide portion 112 within guide passage 108 is substantially fluid-tight and is sufficiently close to valve seat 36 for repeatably accurate centering of the needle tip 116 in valve seat 36 to provide sharper fuel cutoff and better atomization proximate the end of each injection event, as well as increased component life, relative to conventional accumulator-type injectors in which the needle was either unguided or was guided at a location axially remote from the tip.

Injector needle 110 has a flat, transverse top surface 118 at the upper end of its guide portion 112, top surface 118 being located slightly above upper end surface 32 of nozzle body 34. A small locator pin 120 extends axially upwardly from the top surface 118 of the needle to locate a spring guide and needle damper member 122 coaxially relative to needle 110. The guide/damper member 122 fits over locator pin 120 and has a flat annular damping base 124 which seats against the top surface 118 of needle 110. The damping base 124 provides damping flange means for hydraulic damping of needle closure events as described below. A reduced diameter, upwardly projecting spring locator portion 126 of guide/damper 122 provides radial centering for the needle spring. It is to be noted that the top surface 118 of needle 110, and hence also the flat annular base portion 124 of guide/damper 122, is displaced above the upper end surface 32 of nozzle body 34 in the fully closed position of needle 110, which assures complete closure of the needle 110 by the needle spring.

An elongated, cylindrical spring cavity 128 extends axially upwardly from upper end surface 32 of nozzle body 34 through a major portion of the length of accumulator body 26, terminating at an upper end surface 130. The needle spring is a helical compression spring 132 which is axially arranged within spring cavity 128 with its lower end seated against the flat annular base 124 of guide/damper 122 and its upper end seated against the end surface 130 of cavity 128.

Extending axially upwardly from the upper end 130 of spring cavity 128 through the upper end surface 24 of accumulator body 26 is a plunger guide and sealing passage 134 within which the cylindrical upper sealing portion 138 of a needle plunger 136 is slidably and sealingly fitted. Needle plunger 136 has an upper end 140 which is exposed to damper cavity 70 but recessed slightly down into passage 134 below the upper body surface 24, and hence below the bottom surface of stop plate 71, in the normally seated position of plate 71. The amount of clearance between plunger end 140 and plate 71 determines the height of the small preliminary increment of needle lift for injection of the initial or pilot charge. Plunger 136 extends axially downwardly from its upper end 140 as an integral member which includes the cylindrical upper sealing portion 138 and an elongated, cylindrical lower portion 142 which extends through the spring 132 to a lower end 144 which faces and is proximate the upward projection 126 of needle guide/damper 122. Spring cavity 128 communicates through a vent passage 146 to fuel supply conduit 76 at the interface between accumulator body 26 and intensifier body 18.

Needle plunger 136 serves a series of functions in its independent capacity from needle 110 during operation of the intensified accumulator injector 10. First, during the intensification stroke of high pressure piston 52, the intensified fluid pressure in damper cavity 70 operates through stop plate hole 74 against the upper end 140 of plunger 136 to hold plunger 136 down against guide/damper 122 so as to hold needle 110 down against needle valve seat 36 with the aid of spring 132 against the upward force of the intensified pressure in the accumulator cavity against the lower part of needle 110.

Second, the length of needle plunger 136 defines the amount of clearance between plunger end 140 and the seated stop plate 71. At the onset of the needle opening event, intensified fluid pressure acts downwardly on a larger surface of plate 71 than upwardly on plate 71 because a portion of the lower surface of plate 71 is masked by its lapped fit against upper body surface 24 and thus is subject to only fluid vapor pressure. Thus, shortly after the onset of the needle opening event, plate 71 positively stops plunger 136, and hence needle 112, at a small percentage of full needle lift, and time for injection of the initial or pilot charge is provided until the intensified pressure above plate 71 is vented sufficiently to allow needle 112 and plunger 136 to unseat plate 71 and to move plate 71 upwardly from body surface 24.

Third, the mass of plunger 136 is added to the mass of needle 110 to damp and slow down the beginning of the needle opening event, which is an added factor in allowing time for the initial or pilot charge in cavities 104 and 106 to be injected into the engine cylinder before it can be overtaken by the main charge from the larger primary accumulator cavity.

Fourth, with needle 110 and its plunger 136 joined as an effectively unitary structure during the opening stroke of needle 110, the upper end 140 of plunger 136 is enabled to be utilized in cooperation with plate 71 to damp the end of the needle opening event. When plate 71 is moved upwardly by plunger 136 in its damper cavity 70, displacement of fluid by plate 71 is limited by the constriction between the periphery of plate 71 and the annular wall of damper cavity 70, and by the narrowing constriction between the top of plate 71 and shoulder 73, thereby damping the upper end of the needle opening event by a hydraulic damping action which may be referred to as "squish damping". This prevents needle bounce at the end of the opening event.

Fifth, and of great importance in enabling a very rapid needle closing event to be achieved, the separation of needle plunger 136 from needle 110 enables needle 110 to be relatively short and of very low mass as compared to conventional accumulator injector needles, so that needle 110 can be accelerated very rapidly by spring 132 to achieve a very rapid needle closing event. The low mass and short length of separated needle 110 also minimize the amount of compression energy that can be stored in the needle upon impacting the seat, and correspondingly minimizes needle closing bounce. The mass of separated needle 110 may be as little as one-third or less than the mass of conventional accumulator injector needles, and the closing acceleration of the low mass, separated needle 110 is estimated to be in the range of from about 10,000–20,000 Gs.

With such a high speed needle closing event, it is desirable to damp the end of closure to assure against needle bounce, even with the short, light-weight needle, and this function is performed by guide/damper 122. As guide/damper 122 and needle 110 more downwardly during the needle closing event, fluid at rail pressure must be displaced from below guide/damper 122 through the constriction between the periphery of its flat annular base 124 or damping flange means and the wall of spring cavity 120 to above base 124. The guide/damper thus serves as a shock absorber to hydraulically damp the needle closure in a squish damping action, cushioning the end of the injection event. This is a further factor in preventing the needle from dynamically or mechanically bouncing from compression energy that might otherwise be stored along the length of the needle upon impacting the seat. This closing damper effect can be adjusted by adjusting the radial clearance between the periphery of guide/damper base 124 and the surface of spring cavity 128, or by adjusting the axial clearance between the bottom of guide/damper base 124 and upper surface 32 of nozzle body 34, or by making both adjustments.

If desired, a slight annular relief cavity (not shown) may be provided in the wall of spring cavity 128 offset above the lower end of cavity 128 so as to allow fluid to bypass the periphery of guide/damper base 124 more freely during the early part of the needle closing stroke, while still presenting the full constriction between the periphery of base 124 and the wall of spring cavity 128 during the final phase of the closure stroke. However, experiments have shown that the shock absorbing effect of the fluid constriction between the periphery of guide/damper base 124 and the unrelieved cylindrical wall of spring cavity 128 effectively eliminates secondary injections from needle bounce without detrimentally slowing down the high rate of needle closure enabled by the short, very low mass needle 110. Cooperating in such elimination of needle bounce is the very fact that the needle is short. This causes minimization of the amount of longitudinal elastic compression energy that can be stored in the needle upon impact with the seat.

Spring cavity 128, in addition to serving the functions of housing needle return spring 132 and cooperating with guide/damper 122 to damp the closure stroke of needle 110, also serves as a collector for any intensified pressure fuel which may seep between the upper sealing portion 138 of needle plunger 136 and its passage 134, or between the upper guide portion 112 of needle 110 and its guide passage 108, or from annular cavity 92 radially inwardly past the inner interface between lower accumulator body surface 30 and upper nozzle body surface 32.

2. Operation of the First Embodiment

Overall and specific systems for operating an intensifier-type accumulator injector of the general type of the present invention are illustrated and described in detail in the Beck et al. U.S. Pat. No. 4,628,881, including the aforesaid high speed solenoid actuated control valve, and such systems are fully applicable for operating the intensifier-type accumulator of the present invention. Accordingly, the Beck et al. U.S. Pat. No. 4,628,881 is hereby incorporated by reference for its disclosures of apparatus and methods for operating the intensifier-type accumulator injectors 10 of the present invention.

Operation of the present invention is best understood with reference to FIGS. 1, 4, 8 and 10–12 of the drawings. FIG. 1 illustrates injector 10 in a position of repose prior to a sequence of intensification and injection events. Inlet/vent passage 64 is vented to a sufficiently reduced pressure, which may be essentially atmospheric pressure, to enable spring 62 to bias low pressure piston 48 and high pressure piston 52 to their uppermost positions, with the lower end 56 of high pressure piston 52 above fuel inlet cross conduit 78. Fuel supply conduit 76 is constantly supplied with fuel at rail pressure, and high pressure cylinder 50 below piston 52 has been filled with fuel at rail pressure from fuel supply conduit 76 through inlet conduit 78 and fuel port 79. Injector needle 110 is closed against needle valve seat 36, and accumulator inlet check valve 88 is also closed, with the fuel pressure within the accumulator cavity static at the needle closure pressure, which is preferably relatively high for a crisp needle closing event with good fuel atomization right up to closure and minimal, if any, fuel dribble proximate closure. Typically, this static, residual pressure within the accumulator cavity will be in the range of from about 3,000 psig to about 6,000 psig, and preferably it will be in the high pressure part of this range for best fuel cutoff characteristics. Needle stop plate 71 is biased by spring 72 to its sealed position against the upper surface 24 of accumulator body 26. Needle plunger 136 may, in this rest condition of injector 10, be in any position from where its lower end 144 is in contact with guide/damper 122 to where its upper end 140 is in contact with stop plate 71.

An intensification stroke is caused by introduction of fuel at rail pressure through actuating fluid inlet passage 64 into low pressure cylinder 46 to drive low pressure piston 48 downwardly, piston 48 carrying high pressure piston 52 downwardly with it for the intensifying stroke, the extent of this stroke being determined either by the time duration of application of rail pressure through passage 64 for time metering or by the pressure of the fluid introduced through passage 64 for pressure metering. The maximum travel of this intensification stroke is to the position of high pressure piston 52 shown in FIG. 4, with the upper end of reduced portion 57 still being located above the high pressure cylinder outlet port 83 so that port 83 remains clear. During this downward intensification stroke of the pistons, fuel is pressurized and compressed within high pressure cylinder 50, and such pressurization and compression is transmitted into the entire accumulator cavity through high pressure cylinder outlet port 83, cross-conduit 82, longitudinal passage 86, check valve 88, and accumulator bore 90, the pressurized, compressed fuel passing from bore 90 into annular cavity 92 and thence into accumulator bores 94, 96, 98 and 100, and also downwardly through nozzle passages 102 into kidney cavity 104 and needle cavity 106. The quantity of fuel thus poised in the accumulator cavity for injection depends upon the amount of compression of the fuel within the accumulator cavity, which depends upon the amount of pressure provided by the intensifier stroke, and this may range from about 6,000–7,000 psig for minimum engine power at idle up to about 22,000 psig or even higher for maximum engine power.

During the intensification stroke, the increasingly high intensified pressure within high pressure cylinder 50 is applied through damper cavity 70 to the upper end surface 140 of needle plunger 136. Plunger 136 seats against guide/damper 122 and transmits the resulting force of the intensified pressure to guide/damper 122 and thence to top surface 118 of needle 110, and this force, together with the force of needle spring 132, securely hold needle 110 down on its seat 36. This downward force on needle 110 is greater than the upward force as determined by the intensified pressure within kidney cavity 104 and needle cavity 106 operating upwardly on the differential area between the cross-section of upper guide portion 112 of the needle and the area of the needle seat.

At the end of the intensification stroke, injector 10 is ready for an injection event, which is initiated by venting the actuating fluid inlet/vent passage 64, and hence low pressure cylinder 46, to a reduced pressure. This allows piston spring 62 to move both of the pistons 48 and 52 upwardly at a rate which may be controlled by orificing of passage 64, which now serves as a vent conduit. The mode of operation of the two-stage needle lift is best understood with reference to the graph or chart in FIG. 10.

Figure 10:
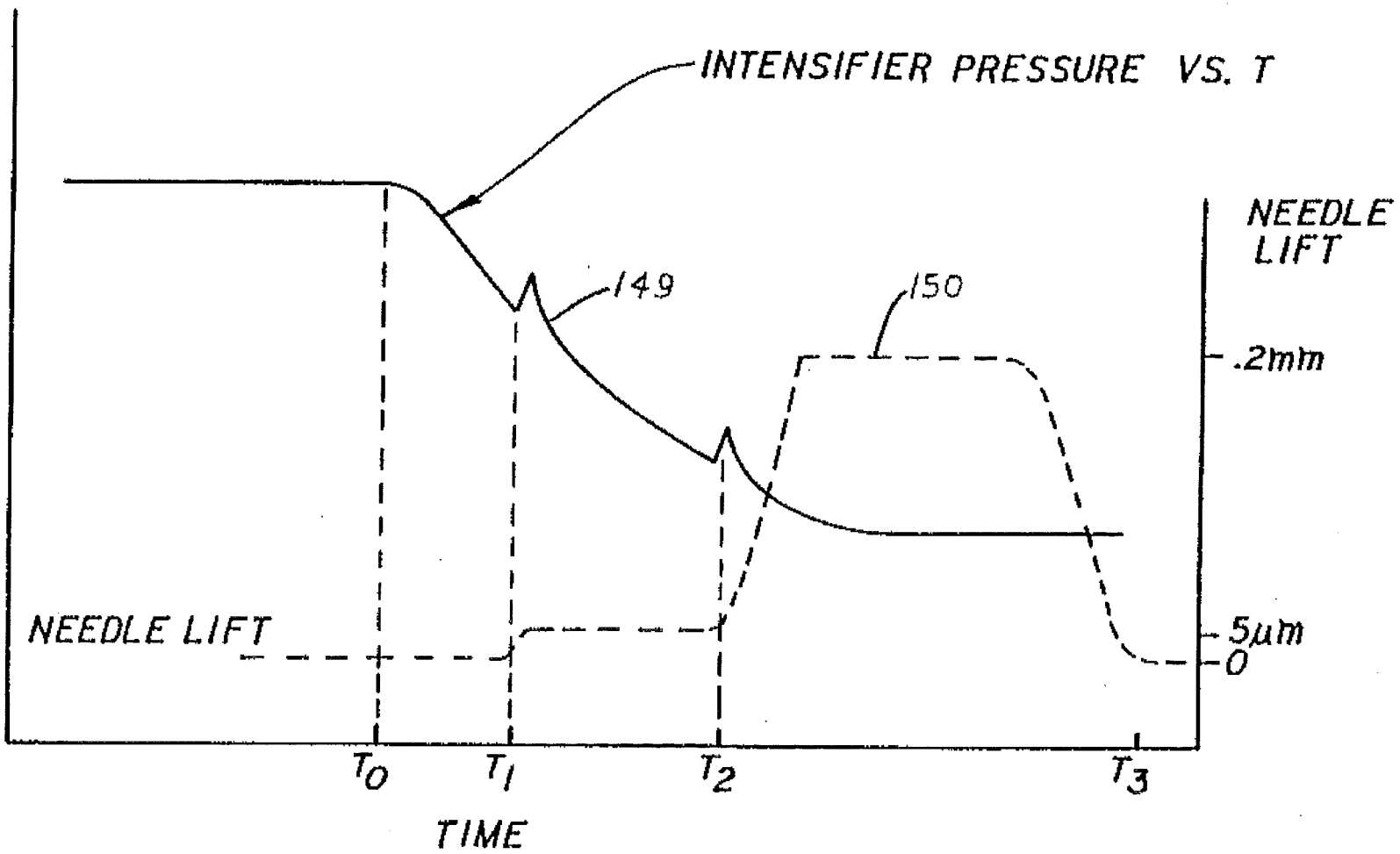
FIG. 10 is a graph or chart illustrating the two-stage needle lift of the invention.

The solid line curve 149 in FIG. 10 represents a plot of intensifier pressure (the pressure within intensifier cylinder 50) versus time. Curve 149 shows the rate of decay of pressure in intensifier cylinder 50 as it may be controlled by orificing of vent passage 64. Adjustment of the orificing of vent passage 64 will cause a corresponding adjustment of the rate of decay or slope of pressure/time curve 149. Thus, a greater constriction of the orificing in passage 64, with a reduced vent flow rate, will result in a flatter pressure/time curve 149; while a lesser constriction in passage 64, with corresponding increased vent fluid flow through passage 64, will result in a steeper slope for pressure/time curve 149.

The dotted line curve 150 represents needle position versus time, and shows how the needle lift timing relates to the intensifier pressure decay represented by curve 149.

At time $T_0$ the injection event is set into motion by commencement of venting of low pressure cylinder 46 through vent passage 64. At this time the needle is closed, or has zero lift. As the pressure decays from $T_0$ to $T_1$, the needle remains closed because $$A1(P_{int})>P_{acc}(A_{stem}-A_{seat})-F_s$$

where $A_{p1}$ is the cross-sectional area of upper portion 138 of plunger 136

$P_{int}$ is pressure in intensifier cylinder 50

$P_{acc}$ is pressure in the accumulator cavity $A_{stem}$ is the area of the upper guide portion 112 of needle 110

$A_{seat}$ is the area of the needle valve seat $F_s$ is the force of needle spring 132.

The needle lifts initially to its prelift increment at time $T_1$ when $A_{p1}(P_{int})=P_{ac}(A_{stem}-A_{seat})-F_s$. This initial prelift increment is preferably in the range of from about 1–20 percent of maximum needle lift. It is shown on curve 150 as being approximately 5 micrometers, or 0.005 millimeters. This low-lift or prelift increment of the needle lift is defined when the upper end 140 of plunger 136 is stopped against the bottom surface of stop plate 71 which is seated and sealed against upper surface 24 of accumulator body 26. The upward blip of pressure/time curve 149 at $T_1$ represents a momentary pressure surge in intensifier cylinder 50 caused by the upward shift of plunger 136. Between $T_1$ and $T_2$, stop plate 71 remains seated against body surface 24 to hold the needle at the fixed prelift increment because $$A_{p2}(P_{int})+F_{s1}>P_{acc}(A_{stem}-A_{seat})-F_s$$

where $A_{p2}$ is the cross-sectional area of stop plate 71 which is sealed against upper body surface 24

$F_{s1}$ is the force of plate spring 72.

The needle lifts completely starting at time $T_2$ when $$A_{p2}(P_{int})+F_{s1}=P_{acc}(A_{stem}-A_{seat})-F_s$$

In the example of FIG. 10, full needle lift is approximately 0.2 millimeters. At time $T_2$, stop plate 71 becomes unseated from upper body surface 24 so that the seal between the plate 71 and the shoulder of surface 24 is broken and the vapor pressure acting on the bottom 71' of the plate 71 increases to the ambient pressure in cavity 70. Plate 71 then shifts upwardly to become seated on stop shoulder 73. The pressure blip proximate T2 is caused by a transitory pressure surge in intensifier cylinder 50 when plunger 136 and stop plate 71 shift upwardly.

The volume of the initial or pilot charge will vary generally proportionally to both the time duration between $T_1$ and $T_2$ and the height of the needle prelift increment, both indicated by the dotted line curve 150. It is preferably about 2–20 percent of the total fuel charge, and most preferably about 5–10 percent of the total charge.

Figure 11:
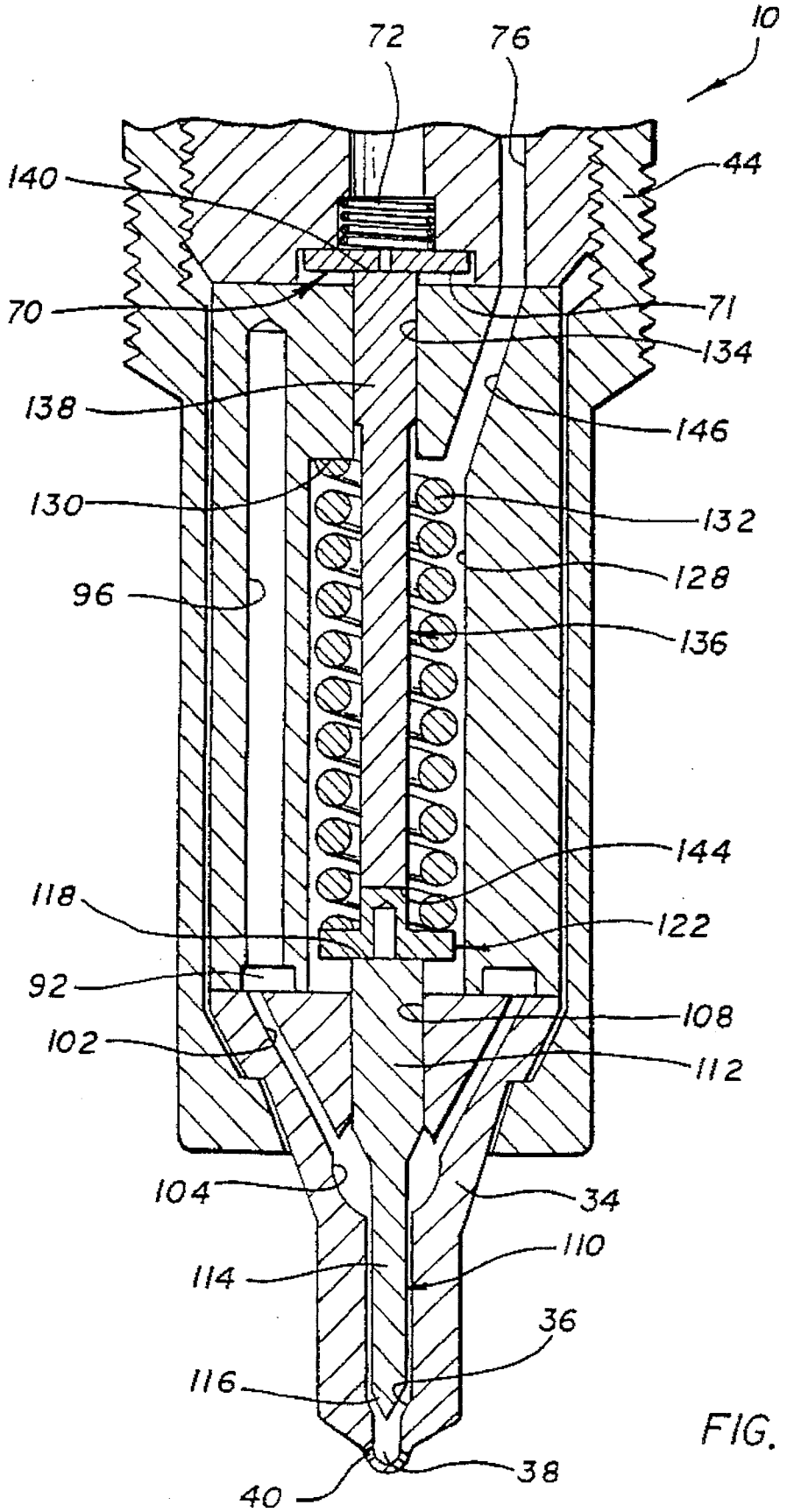
FIG. 11 shows a lower portion of FIG. 1, but with the needle in its fully lifted position.

In FIG. 11, needle 110 is shown in its fully open position, with needle 110, guide/damper 122, plunger 136 and stop plate 71 all closed together in a solid column, and stop plate 71 seated against shoulder 73.

The two phases of needle opening movement proximate $T_1$ and $T_2$ are slowed down and controlled by addition of the mass of plunger 136 to the mass of needle 110. The very short distance needle 110 and plunger 136 travel during the prelift phase does not allow enough momentum to build up in the needle/plunger combination to jar plate 71 off of its seated, sealed position. Then, when needle 110, plunger 136 and plate 71 move on upwardly in the second opening phase for the main injection, plate 71 damps the end of the opening event by hydraulic squish damping. This is caused both by the closely constricted peripheral zone between the outer annular surface of plate 71 which restricts fluid flow from above to below plate 71, and by the narrowing gap as the upper surface of plate 71 approaches its mating shoulder 73. The result is substantial elimination of needle bounce at the end of the opening event, with better spray uniformity at the beginning of the main part of the injection.

The needle remains open during the second phase or main part of the injection event as long as $$P_{acc}(A_{stem})>F_s$$

The needle closing event commences when $$P_{acc}(A_{stem})=F_s$$

Needle closure then occurs rapidly until complete closure occurs at time T3. Separation of needle 110 from plunger 136 during needle closure greatly reduces the effective mass and hence the inertia of the needle so that needle 110 can be accelerated very rapidly by spring 132 to achieve a rapid, crisp closing event; while at the same time, the low mass and short length of the separated needle 110 minimize needle bounce by minimizing the amount of compression energy that can be stored in the needle upon closing impact with the seat.

Figure 12:
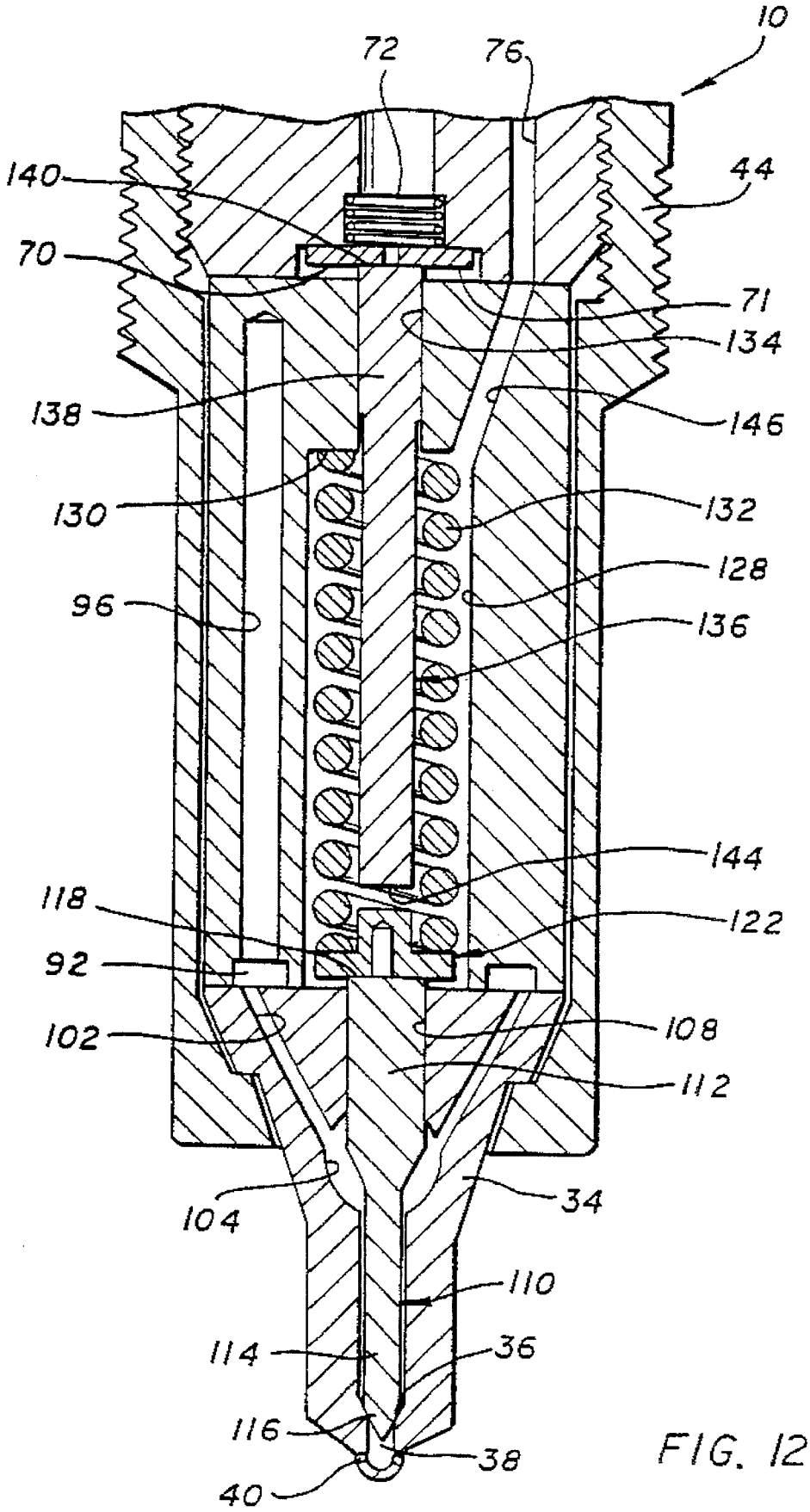
FIG. 12 is a view similar to FIG. 11, illustrating closure of the needle separated from the needle plunger.

FIG. 12 illustrates the separation of needle 110 and its guide/damper 122 from needle plunger 136 during the closing event. Since needle 110 and guide/damper 122 are completely separate parts from needle plunger 136, they are enabled to be driven entirely independently of plunger 136 from the open position of FIG. 11 through the closing event to the closed position of FIG. 12.

Needle bounce is also minimized by the squish damping effect resulting from the small clearance between the flanged periphery of guide/damper 124 and the cylindrical surface of spring cavity 128, and also by the limited clearance between the bottom of guide/damper 124 and the upper surface 32 of nozzle body 34. The very light-weight, short needle 110 cooperates in such squish damping by minimizing the amount of needle inertia which must be controlled by the damping. With these factors cooperating, needle bounce is substantially eliminated in the present invention. With relatively high closing accumulator pressure, the rapid, crisp closing event, coupled with the substantial elimination of closing needle bounce, enable full fuel atomization to be maintained right up to needle closure, for optimum ignition. The sharp closure cutoff and elimination of fuel dribble at closure are important in the elimination of smoke and hydrocarbon emissions.

It is to be noted that the needle closure damper, represented by the guide/damper and its small clearances relative to the surface of spring cavity 128 and surface 32 of nozzle body 34, is remote from needle tip 116 and valve seat 36. This permits efficient shaping of the needle tip and valve seat for a high flow coefficient as the needle approaches the seat during closure. Such high flow coefficient enables high pressure to be maintained proximate the seat for good atomization up to closure.

Another factor which assures sharp fuel cutoff at needle closure is the close proximity of needle guide portion 112 in guide passage 108 to the needle seat 36. By this means, the needle is continuously guided for consistent concentric seat contact. This is a factor in making the end of the injection event stronger than for conventional accumulator injector needles, with resulting better atomization at the end of injection. Consistent concentric closure contact of the needle in the seat assures a high flow coefficient and consequent high closing pressure and good atomization.

Referring again to FIG. 10, although the invention is not limited to any particular time intervals, typically the time from $T_0$ to $T_1$ will be on the order of about 0.1–0.3 milliseconds, and the time from $T_1$ to $T_2$ will be on the order of about 4–8 milliseconds. By way of comparison, with a conventional accumulator-type injector, the needle will be fully opened in on the order of about 0.2 milliseconds.

As an alternative to, or in addition to, controlling the rate of decay of the intensifier pressure as represented by curve 149 in FIG. 10 by means of orificing of vent passage 64 to slow down the vent rate from low pressure cylinder 46, the vent rate from low pressure cylinder 46 can also be controlled by adjusting the pressure level in the vent line. Thus, by raising the vent pressure in passage 64, the differential pressure between low pressure cylinder 46 and vent passage 64 will be lowered, correspondingly lowering the rate of fluid venting from low pressure cylinder 46, and accordingly flattening the intensifier pressure/time curve 149 in FIG. 10. Conversely, lowering of the vent pressure level in vent passage 64 will increase the pressure differential between low pressure cylinder 46 and vent passage 64, steepening the intensifier pressure/time curve 149 in FIG. 10. Such adjustments will, therefore, vary the time intervals between T0 and T1 and between T1 and T2.

The two-stage opening of the needle in the present invention to provide a small initial or pilot charge followed by the main charge has important benefits. The small amount of fuel in the pilot charge will ignite before the needle opens fully, so that the fire has started when the main charge is injected. This causes the main charge to ignite immediately upon injection, without the usual larger percentage of the main charge being injected before it ignites. This provides a great reduction in noise and also greatly reduces undesirable exhaust emissions, principally oxides of nitrogen.

In the foregoing description of the intensified form 10 of the invention, full needle lift has been indicated as being determined by engagement of stop plate 71 against stop shoulder 73. This will always be true for high power engine settings. However, the amount of needle lift off of its seat will actually vary generally in proportion to the difference between the opening and closing pressures of the accumulator. Accordingly, it is to be understood that for low and intermediate engine power settings, typically the needle will not lift off of the seat during the second, main phase of the injection sufficiently for stop plate 71 to fully seat against shoulder 73.

3. Variations of First Embodiment

FIG. 9 illustrates a modified stop plate **71*a* which defines the prelift increment by the depth of a downwardly facing annular, axial recess 147 in plate 71*a*. Here, in the lowermost position of plunger 136*a* which is shown, its top surface 140*a* registers with the upper surface 24 of accumulator body 26. This modification enables stop plate 71*a* to be thicker than stop plate 71 of FIGS. 1, 4 and 8, thereby minimizing the possibility of flexure of plate 71*a* when it is impacted by plunger 136*a*, so as to assure maintenance of the seal between the bottom surface of plate 71*a* and the upper body surface 24. Damper cavity 70*a* in intensifier body 18*a* is made correspondingly deeper to accommodate the thicker plate 71*a*. An important advantage of the FIG. 9 form is that axial dimensioning of the intensifier and accumulator bodies and of the needle/plunger combination is not critical, and correct dimensioning for proper operation of the stop/rate plate can be simply achieved by selecting a stop/rate plate 71*a* having a recess 147** of any desired axial depth. This simplifies manufacture, minimizing surface machining tolerances.

B. Second Embodiment

FIGS. 13–19 illustrate a further form of the invention which is generally designated 500. Injector 500 is an intensifier-type fuel injector which appears generally similar to the first form shown in FIG. 1–12, but there are a number of distinctions between the two injectors. First, injector 500 has a unitary, short, lightweight needle, rather than a longitudinally divided needle having both lower needle and upper plunger sections as in FIGS. 1–12. Second the stop/rate plate and its cavity in the injector form 500 are proximate the lower end of the injector, the plate seating against the top surface of the nozzle body and coacting directly with the top of the short needle, rather than with a needle extension plunger as in the FIGS. 1–12 form. Third, the stop/rate plate of the injector 500 is the bottom-recessed-type plate like that shown in FIG. 9, with its associated manufacturing advantages. Fourth, the accumulator cavity of injector 500 is coaxial with and located axially between the needle and the intensifier, with the needle return spring located in the accumulator cavity, and with the accumulator ball check valve located coaxially between the accumulator and the intensifier, rather than the accumulator cavity consisting of peripheral bores outside of a separate needle spring cavity and the accumulator ball check valve being laterally offset from the axis of the injector, as in the FIGS. 1–12 form. Fifth, the intensifier low pressure piston and high pressure plunger are hydraulically returned to their uppermost starting positions upon injection, without need of a return spring such as that employed in the FIGS. 1–12 form. Sixth, there is an intensifier plunger over-travel safety feature in injector 500 which stops further and uncontrolled injection events in the event of injector nozzle failure. Seventh, the hydraulic circuitry in the injector itself is quite different from the FIGS. 1–12 form to accommodate these other differences, although the basic hydraulic circuitry external of the injector may be the same. In general, these features of the injector form 500 result in a minimized needle compression column length which provides a high order of injection predictability with close control of injection characteristics, a relatively large and free-flowing accumulator input check valve, and simplified, relatively low-cost manufacturing procedures.

1. Construction of Second Embodiment

Referring to FIGS. 13–19, injector 500 includes an upper intensifier body 502 which has an upper end 504 and a flat, transverse lower end surface 506. Axially aligned with and below intensifier body 502 is an accumulator body assembly which consists of two stacked portions, including an upper accumulator body portion 508 and a lower accumulator body portion 510. The upper accumulator body portion 508 has flat, transverse upper and lower end surfaces 512 and 514, respectively, the upper surface 512 having a lapped seal with lower intensifier body end surface 506. The lower accumulator body portion 510 has respective flat, transverse upper and lower end surfaces 516 and 518, the upper surface 516 having a lapped fit with the lower surface 514 of the upper accumulator body portion 508. Below the aforesaid axially aligned stack of body members is nozzle body 520 which has a flat, transverse upper end surface 522 that has a lapped seal with the lower end surface 518 of lower accumulator body portion 510.

All four of the injector body portions 502, 508, 510 and 520, are locked together in axial alignment by means of a housing 524 that is in the form of an elongated nut. A radially reduced externally threaded lower portion 526 of intensifier body 502 is threadedly gripped by an internally threaded upper end portion 528 of housing 524, with an O-ring seal 530 in the upper end of housing 524 providing a fluid-tight seal against an external annular surface of intensifier body 502. From this threaded upper connection of housing 524 with intensifier body 502, housing 524 extends downwardly in covering relationship over the two accumulator body portions 508 and 510 and nozzle body 520, housing 524 having a radially inwardly turned annular flange 532 at its lower end which axially upwardly grips against a downwardly facing annular shoulder 534 on nozzle body 520.

A. Intensifier Body 502 and Its Components

The upper portion of intensifier body 502 defines an axially oriented low pressure intensifier cylinder or chamber 536 within which a low pressure intensifier piston 538 is axially slidable. The upper limit of travel of piston 538 is defined by an upper end plug 540 within intensifier body 502, the end plug 540 being stopped against upward movement by a lock ring 542 seated in the upper end of body 502. An O-ring seal 544 provides a fluid-tight seal between end plug 540 and intensifier body 502 above piston 538.

The low pressure intensifier piston 538 has a generally flat annular head 548 with an integral upwardly projecting central boss 550. An integral cylindrical skirt 552 extends downwardly from piston head 548 to complete the low pressure intensifier piston 538.

Figure 13:
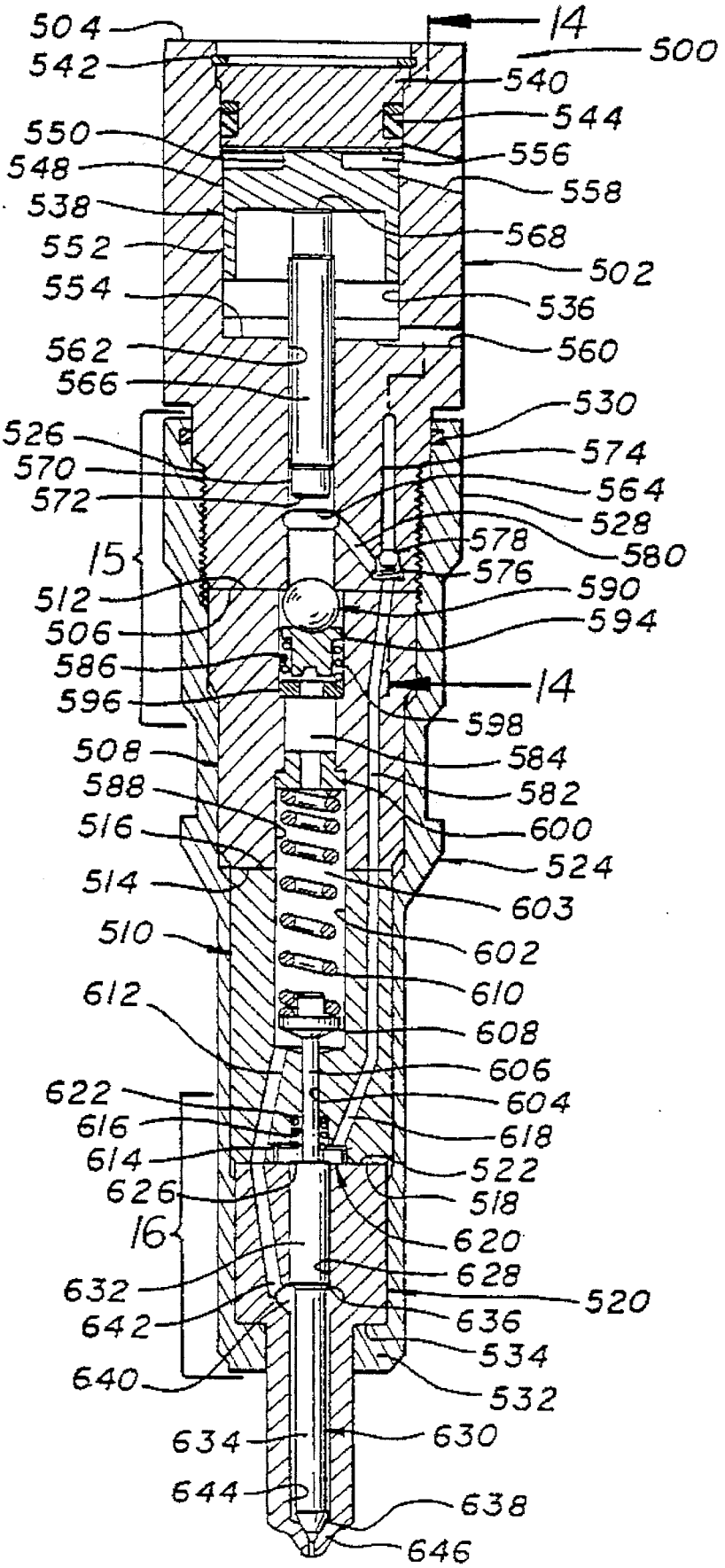
FIG. 13 is an enlarged longitudinal, axial sectional view of a presently preferred form of the present invention having an undivided short needle, with the stop/rate plate located immediately above the top of the needle and the accumulator cavity located generally coaxially above the stop/rate plate.
Figure 17:
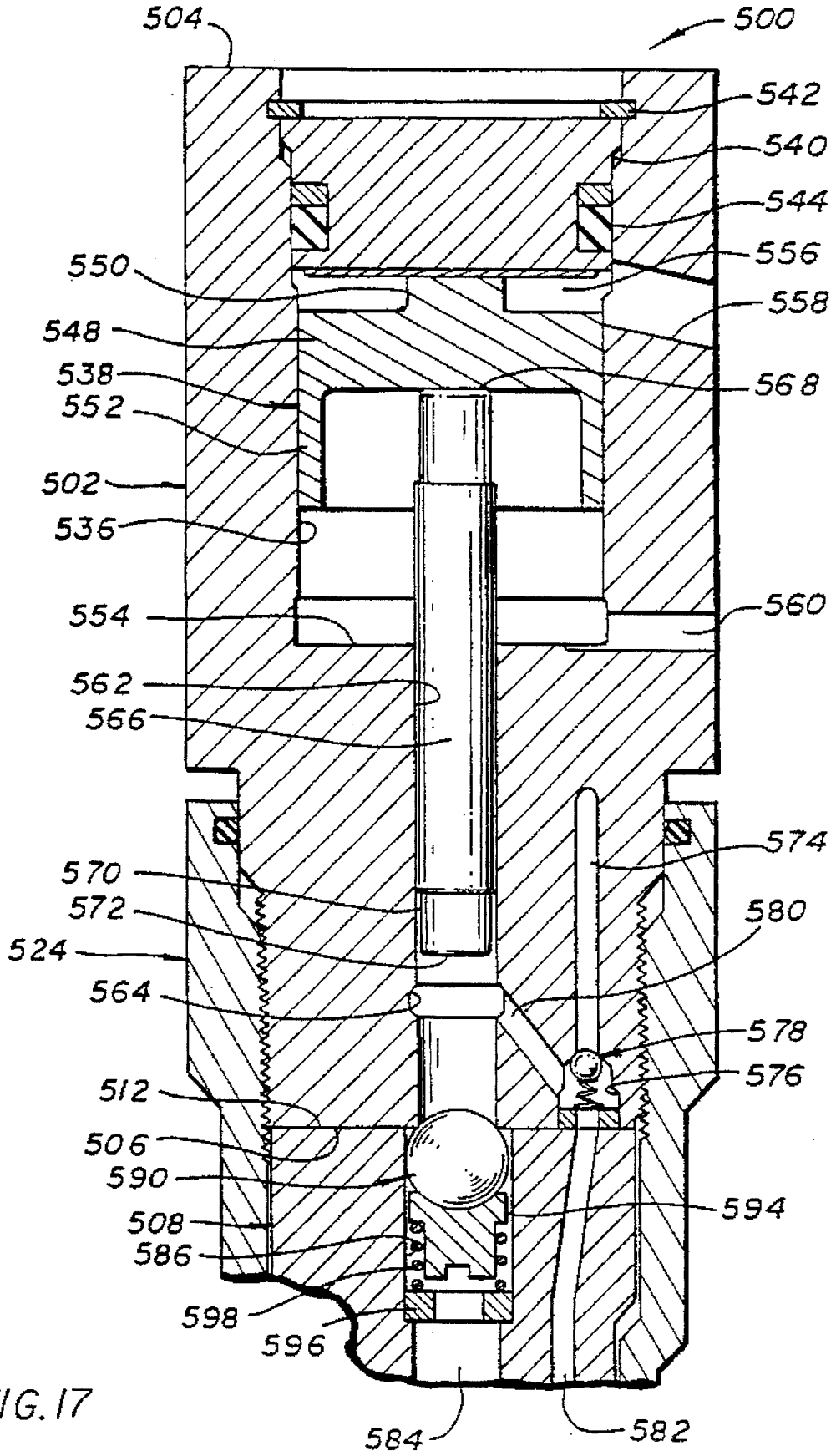
FIG. 17 is a further enlarged, fragmentary view of the upper part of FIG. 13, showing the intensifier piston and plunger in their uppermost positions prior to commencement of a downward intensification stroke, with the accumulator ball check valve in its seated, closed position.
Figure 19:
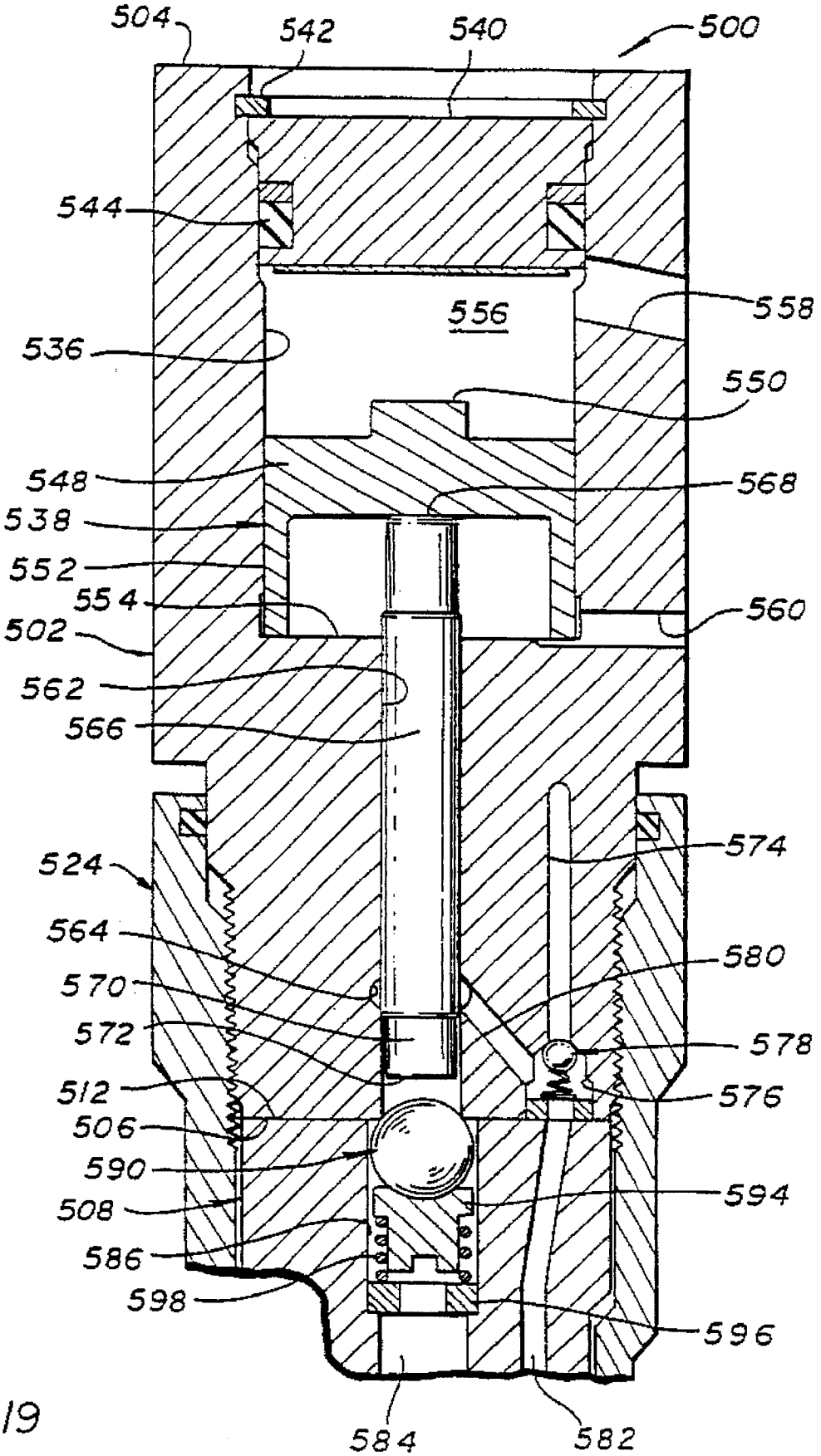
FIG. 19 is a view similar to FIGS. 17 and 18, with the intensifier piston and plunger moved further downwardly from their FIG. 18 positions in an "over-travel" position resulting from nozzle breakage, with the piston bottomed and the plunger in a "safety" position in which it blocks the plunger chamber inlet passage to prevent return upward travel of the intensifier plunger and piston.

Low pressure intensifier cylinder 536 has a generally closed, upwardly facing bottom surface 554 which defines an absolute lowermost limit of travel of piston 538 by engagement of the piston skirt 552 against it, as seen in FIG. 19. This represents an abnormally low position of piston 538 which will be reached only in the unlikely event of injector nozzle failure, as described in detail below. The uppermost limit of travel of piston 538 is defined by engagement of the piston head boss 550 against the bottom surface of end plug 540 or against a spacer shim on the underside of plug 540 as seen in FIG. 13 and 17. Boss 550 thus assures head space 556 above piston head 548 at all times, even when piston 538 is in its uppermost position of FIGS. 13 and 17. A generally transverse actuating fluid inlet/vent passage 558 communicates through the wall of intensifier body 502 to the upper end of cylinder 536 and hence to this head space 556. A generally transverse vent passage 560 also extends through the wall of intensifier body 502 so as to communicate with low pressure cylinder 536 proximate the bottom of cylinder 536. Veto passage 560 provides pressure and vacuum relief from the underside of piston 538 during axial movement of piston 538 within cylinder 536.

Within intensifier body 502 coaxially below low pressure cylinder 536 is a relatively small high pressure intensifier cylinder or chamber 562 which opens upwardly through the bottom surface 554 of the low pressure cylinder 536, and extends axially downwardly through the entire lower portion of body 502, opening downwardly through the lower end surface 506 of body 502. High pressure cylinder 562 has an annular inlet recess 564 in its lower portion. High pressure intensifier plunger 566 is axially slidable within high pressure cylinder 562, having an upper end 568 which abuts against the underside of low pressure piston head 548 in all axial locations of piston 538 and plunger 566. Plunger 566 has a reduced diameter lower end portion 570 providing an annular relief that extends to the lower end 572 of plunger 566.

Figure 18:
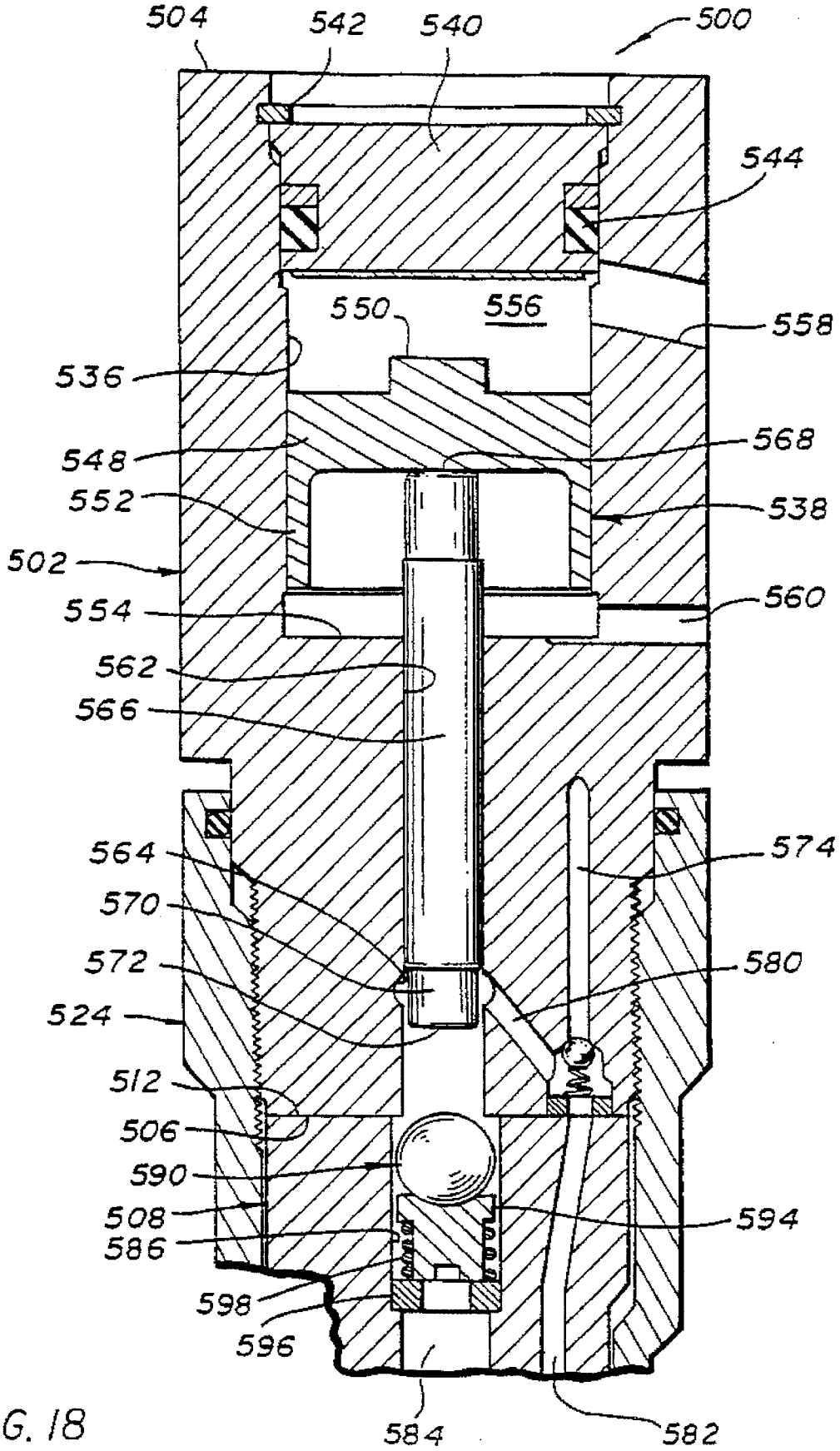
FIG. 18 is a view similar to FIG. 17, with the intensifier piston and plunger moved downwardly to a normal position at the completion of an intensification stroke, with the accumulator ball check valve shown still in its unseated, open position.

A rail pressure fuel source conduit 574 extends generally downwardly through intensifier body 502, providing a constant connection to rail pressure within intensifier body 502. Conduit 574 communicates with a check valve chamber 576 within the lower portion of body 502, and a ball check valve 578 provides one-way communication of rail pressure fuel through an inlet passage 580 to the high pressure intensifier cylinder 562 at annulus 564. In the uppermost position of plunger 566 as seen in FIGS. 13, 15 and 17, the lower end 572 of plunger 566 is offset substantially above inlet annulus 564. At the normal lowermost position of plunger 566 as seen in FIG. 18, the lower end relief portion 570 of plunger 566 communicates with the inlet annulus 564. Thus, in all normal positions of plunger 566, there is communication with rail pressure fuel for inlet flow of rail pressure fuel through check valve 578 to provide fuel within the lower portion of cylinder 562 during each upward fill stroke of plunger 566; while check valve 578 will block reverse flow of fuel during each downward intensification stroke of plunger 566.

B. Accumulator Body Upper Portion 508

An intensification fuel communication passage 582 extends from check valve chamber 576 downwardly through the entire length of upper accumulator body portion 508, receiving intensified fluid pressure during downward intensification strokes of plunger 566, and being relieved back to substantially rail pressure during upper injection and fill strokes of plunger 566. Communication passage 582 is substantially laterally offset from the axis of body portion 508.

A central bore 584 extends axially through the length of body portion 508, having respective upwardly opening and downwardly opening counterbores 586 and 588. Accumulator ball check valve 590 is freely axially shiftable in upper counterbore 586. A ball guide member 594 is engaged under ball 590, and is axially shiftable from an upper valve-closed position as seen in FIGS. 13, 15, 17 and 19 to a lower valve-open position as seen in FIG. 18 in which it is engaged against a stop ring 596 in the lower end of upwardly opening counterbore 586. Helical check valve compression spring 598 is engaged between stop ring 596 and guide member 594 to bias ball 590 to a normally closed, seated position against the lower end rim of high pressure intensifier cylinder 562 as seen in FIGS. 13, 15, 17 and 19. A ferrule-shaped needle spring seat 600 is fixedly seated in the upper end of downwardly opening counterbore 588.

C. Accumulator Body Lower Portion 510

The lower accumulator body portion 510 has a relatively large diameter upwardly opening axial bore portion 602 which communicates with the downwardly opening counterbore 588 of accumulator body portion 508. Bore portions 588 and 602 together define accumulator chamber 603. A relatively small axial bore extends downwardly through the lower portion on body 510 for receiving an axial seal pin 606. An annular spring adapter 608 is engaged against the top of seal pin 606 in the lower portion of accumulator chamber 603, and helical compression needle closure spring 610 in accumulator chamber 603 is engaged between adapter 608 and spring seat 600 to provide downward spring closure force through seal pin 606 to the top of the injector needle as seen in FIGS. 13 and 16. A needle force adjust shim may be interposed between adapter 608 and spring 610 as shown. An accumulator pressure fuel communication passage 612 extends downwardly from the lower end of accumulator chamber 603 through body 510 and its lower end surface 518.

Seal pin bore 604 has a downwardly opening, stepped counterbore consisting of a relatively large diameter, downwardly opening counterbore portion defining the stop/rate plate cavity 614, and a relatively small diameter inner counterbore portion defining a stop/rate plate seating spring cavity 616. An intensification pressure fuel communication passage 618 extends from passage 582 in upper accumulator body portion 508 down through lower accumulator body portion 510 into communication with stop/rate plate cavity 614.

The stop/rate plate is designated 620, being generally ring-or washer-shaped with a central circular aperture through which seal pin 606 extends. The bottom surface of stop/rate plate 620 is flat, and has a lapped seal against the upper end surface 522 of nozzle body 520. Stop/rate plate 620 is biased downwardly to a normally flush engagement against nozzle body surface 522 by means of plate seating spring 622 which extends downwardly from spring cavity 616 into plate cavity 614 and against the top of plate 620. Plate 620 preferably has a plurality, such as four, of radially extending ribs on its upper surface which allow free flow of fuel above stop/rate plate 620 at all times, and also serve to center spring 622 above plate 620. Suitable peripheral clearance is also provided about plate 620 for free flow of fluid. Stop/rate plate 620 is preferably of the type shown in FIG. 9, having a downwardly opening axial recess 626 for receiving the upper end of the needle so as to define the needle prelift increment of movement. Alternatively, the plate and needle arrangements may, if desired, be generally like that shown in FIG. 8.

D. Nozzle Body 520

Nozzle body 520 has an axial needle guide passage 628 through which the needle, generally designated 630, extends. Needle 630 is a short, lightweight, unitary structure having an enlarged upper guide portion 632 which axially slidably fits within guide passage 628, and a reduced diameter lower shank portion 634, portions 632 and 634 being connected by a generally downwardly facing bevel or chamfer portion 636. The needle shank portion 634 extends downwardly to a frusto-conical needle valve closure tip 638.

Nozzle body 520 defines an annular kidney cavity 640 which communicates in its upper portion with the needle bevel portion 636. An accumulator pressure fuel communication passage 642 extends from kidney cavity 640 upwardly through nozzle body 520 into communication with the accumulator pressure fuel communication passage 612 in lower accumulator body portion 510. Elongated, narrow needle cavity 644 extends downwardly from kidney cavity 640 to needle valve seat 646 proximate the lower end of nozzle body 520.

2. Operation of the Second Embodiment

The mode of operation of the form of the present invention shown in FIGS. 13–19 and structurally described above is essentially the same as the mode of operation described in detail hereinabove for the two-stage needle lift form of the invention shown in FIGS. 1–12, involving the same pressure ratios and parameters, ranges, equations, and other features of operation described in detail for the form of FIGS. 1–12. Accordingly, all such operational factors described relative to FIGS. 1–12 are hereby adopted also for the form of the invention shown in FIGS. 13–19. As with the form shown in FIGS. 1–12, overall and specific systems for operating the intensifier-type accumulator injector of FIGS. 13–19 are illustrated and described in detail in the Beck et al. '881 patent, including the high speed solenoid actuated control valve, and such systems are fully applicable for operating the intensifier-type accumulator injector of FIGS. 13–19. Accordingly, the Beck et al. '881 patent is hereby incorporated by reference for its disclosures of apparatus and methods for operating the intensifier-type accumulator injector 500 of FIGS. 13 –19.

The specific mode of operation for accumulator injector 500 of FIGS. 13–19 will now be described, with minor differences noted from the operation of the form shown in FIGS. 1–12.

In the position of the parts shown in FIGS. 13–18, an injection event has been effected by venting fluid from head space 556 in low pressure intensifier cylinder 536 through inlet/vent passage 558 to a lower-than-rail pressure, which may be essentially atmospheric pressure. Low pressure intensifier piston 538 and high pressure intensifier plunger 566 are at their uppermost positions, having been moved upwardly to these positions by fuel at rail pressure entering the injector through fuel supply conduit 574, passing through check valve 578 and inlet passage 580 into the high pressure intensifier cylinder 562 under high pressure intensifier plunger 566. Accumulator ball check valve 590 is closed under the combined influence of pressure within accumulator chamber 603 which is considerably higher than rail pressure, and check valve spring 598. The needle valve is closed, needle 630 being moved back down to its lowermost position after injection under the influence of needle closure spring 610. The high pressure intensifier cylinder 562 is filled with fluid.

The timed intensification stroke is caused by introduction of fluid at rail pressure through actuating fluid inlet/vent passage 558 into head space 556 at the upper end of low pressure intensifier cylinder 536. Downward movement of low pressure piston 538 moves high pressure plunger 566 downwardly for pressure multiplication of the fuel within high pressure cylinder 562, and when the fluid pressure within high pressure cylinder 562 becomes greater than the residual fluid pressure within accumulator chamber 603, ball check valve 590 unseats downwardly to its position of FIG. 18 to pass this intensified fuel downwardly through bore 584 into intensifier chamber 603. The downward intensification stroke terminates when fluid pressure balance is achieved between high pressure cylinder 562 and accumulator chamber 603, at which time accumulator ball check valve 590 closes. FIG. 18 illustrates the completion of an intensification stroke just before ball check valve 590 closes. The extent of downward travel of high pressure plunger 566 during the intensification stroke will depend upon engine load, longer downward strokes of intensifier plunger 566 corresponding to higher engine loads.

It is presently preferred to employ fluid pressure metering in which rail pressure is varied to accommodate different engine loads, being higher for heavier engine loads and being lower for lighter engine loads. Higher rail pressures result in greater compression within high pressure intensifier cylinder 562, and correspondingly within accumulator chamber 603 with resulting greater injectable fuel volume. Alternatively, pulse width or time duration fuel metering may be employed, or if desired, a combination of pressure metering and pulse width or time metering may be employed.

During the aforesaid downward compression stroke, intensified pressurized fuel communicates downwardly through passage 580, check valve chamber 576, and communication passages 582 and 618 into the stop/rate plate cavity 614. At this time, stop/rate plate 620 remains seated against the upper end surface 522 of nozzle body 520. Stop/rate plate 620 is fluid-locked in its seated position during the intensification stroke by means of hydraulic force differential of the intensified pressure in stop/rate plate cavity 6 14 on plate 620, the same intensified pressure being applied to both the top and bottom surfaces of plate 620, but the effective top surface being greater than the effective bottom surface because of the substantial peripheral portion of the plate 620 which is masked by the lapped surface contact between the bottom of plate 620 and the upwardly facing nozzle body surface 522.

During intensification, needle 630 is held down in its seated position by downward hydraulic force in plate cavity 614 against the top surface of needle 630 and by the force of needle closure spring 610. At this time, such downward closure forces are greater than the upward force of accumulator pressure in kidney cavity 640 and needle cavity 644 against downwardly facing portions of needle 630 (bevel portion 636 and partly masked top portion 638). Such accumulator pressure is applied to kidney cavity 640 from accumulator chamber 603 through passages 612 and 642.

The two-stage needle lift is caused by timed venting of the low pressure intensifier cylinder head space 556 through inlet/vent passage 558 to a lower-than-rail pressure such as essentially atmospheric pressure. As the pressure decays within low pressure cylinder 536, it simultaneously decays within high pressure cylinder 562, and hence through passages 580, 582 and 618 to within plate cavity 614 and against the upper end surface of needle 630. Nevertheless, intensified pressure remains in kidney cavity 640 and needle cavity 644, this intensified pressure overcoming the decaying pressure in plate cavity 614 and causing needle 630 to lift in its low-lift increment where it is stopped against the downwardly facing surface in plate recess 626, needle 630 remaining at this low-lift, pilot injection position for an increment of time until the aforesaid downward pressure-area differential is overcome by the aforesaid upward fluid pressure force on needle 630 to release stop/rate plate 620 from its seated overlapped position and allow needle 630 to lift to a higher, full injection position, the extent of plate lift depending upon engine load. By way of example only, and not of limitation, representative needle lift increments may be on the order of about 0.0005 inch for the prelift increment and 0.012 inch for full lift.

The extent of overlap of plate 620 on nozzle body surface 522 controls the time duration of the prelift pilot injection, while the depth of plate recess 626 controls the rate of pilot injection fuel flow. Thus, these two features of the stop/rate plate 620 synergistically control the fuel volume of the pilot injection.

During injection, intensified pressurized fuel flows from accumulator cavity 603 through communication passages 612 and 642, kidney cavity 640 and needle cavity 644 through the injector nozzle, until the intensified pressure decays to the point where upward fluid pressure on needle 630 is overcome by downward fluid pressure on the top surface of needle 630 and the force of needle return spring 610, at which time needle 630 closes against valve seat 646, closing off accumulator cavity 603 at substantially higher than rail pressure, and allowing stop/rate plate 620 to again seat flush against the upwardly facing nozzle body surface 522. The upward force of fuel at rail pressure in high pressure intensifier cylinder 562 moves both intensifier plunger 566 and piston 538 back upwardly to their uppermost positions as viewed in FIGS. 13, 15 and 17. Injector 500 is then ready for sequential injection events.

3. Over-Travel Safety Feature

As described above, the intensifier-type fuel injector 500 utilizes hydraulic rail pressure to return the intensifier piston 538 and plunger 566 to their uppermost positions. Under normal operating conditions, the downward travel of plunger 566, and hence also of piston 538, stops during an intensification stroke when the pressure within high pressure cylinder 562 balances with the pressure in accumulator chamber 603, and as illustrated in FIG. 18, the return rail pressure inlet annulus 564 remains, effectively, under intensifier plunger 566, since annulus 564 remains in communication with the relief portion 570 at the bottom of plunger 566. FIG. 18 shows the lowermost position of plunger 566 under maximum load conditions, with such communication still fully in effect.

However, in the event of injector nozzle breakage, cracking or other failure preventing complete valve closure, the balancing pressure may be relieved from accumulator chamber 603 since injector needle 630 cannot effectively close off the nozzle, and fuel can continue to flow downwardly from accumulator chamber 603 through communication passages 612 and 642, kidney cavity 640 and needle cavity 644, and thence out through the breach. Without a safety feature to prevent further flow of rail pressure fuel into the high pressure intensifier cylinder 562, the result could be a series of further and uncontrolled injection events. However, in the present invention the intensifier parts are so arranged that in the event of such a nozzle breach, the resulting reduced fuel pressure within accumulator chamber 603 will prevent the normal fluid balance from occurring and allow plunger 566 to move downwardly to an over-travel safety position as illustrated in FIG. 19 in which the plunger body above its relief portion 570 seals off the rail pressure fluid inlet annulus 564 to prevent further entry of rail pressure fluid into the intensifier, and thereby positively block any further injection events. Such over-travel is stopped when the skirt portion 552 of low pressure piston 538 bottoms out against the bottom surface 554 of low pressure cylinder 536 under the influence of rail pressure fuel flowing into head space 556 through fluid inlet/vent passage 558.

Of course, the overtravel safety feature need not take the form illustrated and could comprise any device preventing the flow of fuel into the injector upon plunger overtravel. The overtravel safety feature is also not limited to use with an accumulator-type fuel injector, and could be used in any injector employing a pressure intensifier.

While the present invention has been described with regard to particular embodiments, it is to be understood that modifications may be readily be made by those skilled in the art, and it is intended that the claims cover any such modifications which fall within the scope and spirit of the invention as set forth in the appended claims.

We claim:

1. In an internal combustion engine intensified accumulator-type fuel injector, apparatus for preventing uncontrolled injections in the event of injector nozzle failure, which comprises:

low and high pressure intensifier cylinders, with a low pressure piston slidable in said low pressure cylinder and a high pressure plunger slidable in said high pressure cylinder;

said high pressure cylinder having one-way fuel outlet means in communication with an accumulator cavity, and having one-way fuel inlet port means above said outlet means;

said plunger moving downwardly during each normal intensification stroke to a normal lowermost position defined by balanced fuel pressure in the accumulator cavity and said high pressure cylinder below said plunger, and in which lowermost position said inlet port means remains uncovered by said plunger to provide fuel to said high pressure cylinder for the next succeeding intensification stroke; and in the event of injector nozzle failure, reduced balancing pressure in the accumulator cavity allowing said plunger to move below its said normal lowermost position to an overtravel position in which it blocks said inlet port means so as to prevent further and uncontrolled injection events.

2. Apparatus according to claim 1, which comprises stop means in said low pressure cylinder which limits downward travel of said piston and hence also limits the downward extent of said overtravel position of said plunger.

3. Apparatus according to claim 1, wherein said inlet port means comprises an annulus in the wall of said high pressure cylinder, said annulus remaining uncovered by said plunger in said normal lowermost position of said plunger and being covered by said plunger in said overtravel position of said plunger.

4. In an internal combustion engine intensified accumulator-type fuel injector, a method for preventing uncontrolled injections in the event of injector nozzle failure, which comprises:

limiting downward movement of a high pressure intensifier plunger in a high pressure intensifier cylinder during each normal intensification stroke to a normal lowermost position defined by balanced fuel pressure in an accumulator cavity and said cylinder below said plunger, and in which lowermost position inlet port means of said cylinder remains uncovered by said plunger to provide fuel to said cylinder for the next succeeding intensification stroke, and in the event of injector nozzle failure, allowing said plunger to move below its said normal lowermost position under the influence of reduced balancing pressure in the accumulator cavity to an overtravel position in which it blocks said inlet port means so as to prevent further and uncontrolled injection events.

5. A method according to claim 4, which comprises limiting the extent of overtravel of said plunger so that the bottom of said plunger remains above the bottom of said cylinder in said overtravel position of said plunger.

6. A fuel injector comprising:

A. an injector body;

B. an injector nozzle disposed at a lower end of said injector body;

C. pressure intensifier having low and high pressure cylinders, said high pressure cylinder communicating with said injector nozzle and with a source of pressurized fuel, and said low pressure cylinder being selectively connectable to a source of pressurized liquid and to vent, wherein a stepped piston assembly is slidably disposed in said pressure intensifier and includes (1) a relatively large piston surface disposed in said low pressure cylinder and (2) a relatively small piston surface disposed in said high pressure cylinder, said stepped piston assembly normally being operable, upon introduction of pressurized liquid into said low pressure cylinder, to increase the fuel pressure in said high pressure cylinder by a ratio proportional to a ratio of the area of said relatively large piston surface to the area of said relatively small piston surface, and wherein said pressure intensifier is dimensioned and configured such that, (1) during normal operation of said fuel injector, fuel flow is permitted through said high pressure cylinder from said source of pressurized fuel, and (2) in the event of injector nozzle failure, said fuel flow is prohibited by said pressure intensifier by overtravel of said stepped piston assembly beyond a designated stroke, thereby preventing further and uncontrolled injection events.

7. A fuel injector comprising:

A. an injector body;

B. an injector nozzle disposed at a lower end of said injector body;

C. a pressure intensifier having low and high pressure cylinders in which are slidably disposed a low pressure piston and a high pressure plunger, respectively, said high pressure cylinder communicating with said injector nozzle and also communicating with a source of pressurized fuel via an inlet port formed therein, said low pressure cylinder being selectively connectable to a source of pressurized liquid and to vent, said low pressure piston and high pressure plunger being operable, upon introduction of pressurized liquid into said low pressure cylinder, to increase the fuel pressure in said high pressure cylinder in proportion to a ratio of the area of said low pressure piston to the area of said high pressure plunger, wherein said inlet port remains open during normal operation of said pressure intensifier and, in the event of injector nozzle failure, is closed by a surface of said plunger to prevent fuel flow through said high pressure cylinder, thereby preventing further and uncontrolled injection events.

8. A fuel injector comprising:

D. an injector body;

E. an injector nozzle disposed at a lower end of said injector body;

F. a pressure intensifier having low and high pressure cylinders in which are disposed a low pressure piston and a high pressure plunger, respectively, said, high pressure cylinder communicating with said injector nozzle and also communicating with a source of pressurized fuel via an inlet port formed therein, said low pressure cylinder being selectively connectable to a source of pressurized liquid and to vent, wherein said inlet port remains open during normal operation of said pressure intensifier and, in the event of injector nozzle failure, is closed by a surface of said plunger to prevent fuel flow through said high pressure cylinder, thereby preventing further and uncontrolled injection events; and F. an accumulator chamber located in said injector body between said high pressure cylinder and said injector nozzle, and wherein during normal operation of said fuel injector, said plunger moves downwardly during each normal intensification stroke to a normal lowermost position (1) which is defined by a balanced fuel pressure in said accumulator chamber and said high pressure cylinder below said plunger, and (2) in which said inlet port remains uncovered by said plunger to permit fuel to flow into and through said high pressure cylinder, and in the event of injector nozzle failure, reduced balancing pressure in said accumulator chamber allows said plunger to move below said normal lowermost position to an overtravel position in which said plunger blocks said inlet port to prevent fuel flow into said high pressure cylinder, thereby preventing further and uncontrolled injection events.

9. A fuel injector as defined in claim 8, further comprising a stop which extends downwardly from said piston and which limits downward travel of said piston and hence also limits the downward extent of said overtravel position of said plunger.

10. A fuel injector comprising:

A. an injector body;

B. an injector nozzle disposed at a lower end of said injector body; and

C. a pressure intensifier having low and high pressure cylinders in which are disposed a low pressure piston and a high pressure plunger, respectively, said high pressure cylinder communicating with said injector nozzle and also communicating with a source of pressurized fuel via an inlet port formed therein, said low pressure cylinder being selectively connectable to a source of pressurized liquid and to vent, wherein said inlet port remains open during normal operation of said pressure intensifier and, in the event of injector nozzle failure, is closed by a surface of said plunger to prevent fuel flow through said high pressure cylinder, thereby preventing further and uncontrolled injection events, wherein said inlet port comprises an annulus in a sidewall of said high pressure cylinder, and wherein said surface of said plunger comprises a side surface.

11. A fuel injector comprising:

A. an injector body;

B. an injector nozzle disposed at a lower end of said injector body;

C. a pressure intensifier having low and high pressure cylinders, said high pressure cylinder communicating with said injector nozzle and with a source of pressurized fuel, and said low pressure cylinder being selectively connectable to a source of pressurized liquid and to vent, a stepped piston assembly being slidably disposed in said pressure intensifier and including (1) a relatively large piston surface disposed in said low pressure cylinder and (2) a relatively small piston surface disposed in said high pressure cylinder, said stepped piston assembly normally being operable, upon introduction of pressurized liquid into said low pressure cylinder, to increase the fuel pressure in said high pressure cylinder in proportion to a ratio of the area of said relatively large piston surface to the area of said relatively small piston surface, and; and D. means, operable upon failure of said injection nozzle and responsive to overtravel of said stepped piston assembly, for preventing fuel flow through said high pressure cylinder, thereby preventing further and uncontrolled injection events.

12. A fuel injector as defined in claim 11, wherein said relatively small piston surface is formed from an end of a high pressure plunger of said stepped piston assembly, and wherein said means for preventing comprises a surface of said high pressure plunger which, upon said abnormal operation of said pressure intensifier, blocks an inlet port formed in said high pressure cylinder.

13. A fuel injector comprising:

A. an injector body having (1) a longitudinal bore formed therein, (2) an accumulator chamber formed therein at a location above said bore, and (3) a pressurized cavity formed therein at a location above and in fluid communication with an upper end of said bore;

B. an injector nozzle disposed at a lower end of said bore in fluid communication with said accumulator chamber and presenting a valve seat;

C. an injector needle slidably received in said bore and having a needle tip normally seated on said valve seat and an upper end normally disposed proximate a junction between said pressurized cavity and said bore;

D. a stop plate disposed in said pressurized cavity and having (1) an upper surface exposed to ambient fluid pressure in said pressurized cavity, (2) a lower surface normally sealingly contacting a shoulder of said injector body, and (3) a hole formed therethrough permitting the imposition of forces, generated by said ambient fluid pressure in said pressurized cavity, on said upper end of said injector needle;

E. a pin extending through said hole of said stop plate and having (1) a lower end abutting said upper end of said injector needle and (2) an upper end located in said accumulator chamber;

F. a needle spring disposed in said accumulator chamber and seated upon said upper end of said pin; and G. a pressure intensifier having low and high pressure cylinders in which are disposed a low pressure piston and a high pressure plunger, respectively, said high pressure cylinder communicating with said accumulator chamber and also communicating with a source of pressurized fuel via an inlet port formed therein, and said low pressure cylinder being selectively connectable to a source of pressurized liquid and to vent, wherein during normal operation of said fuel injector, said plunger moves downwardly during each normal intensification stroke to a normal lowermost position (1) which is defined by a balanced fuel pressure in said accumulator chamber and said high pressure cylinder below said plunger, and (2) in which said inlet port remains uncovered by said plunger to permit fuel to flow through said high pressure cylinder, and in the event of injector nozzle failure, reduced balancing pressure in said accumulator chamber allows said plunger to move below said normal lowermost position to an overtravel position in which said plunger blocks said inlet port, thereby preventing fuel flow through said high pressure cylinder and preventing further and uncontrolled injection events.

14. A method of injecting fuel comprising:

A. feeding fuel into a high pressure cylinder of a pressure intensifier from an inlet port, said intensifier having (1) said high pressure cylinder, (2) a low pressure cylinder selectively connectable to a source of pressurized liquid and to vent, (3) a low pressure piston slidably disposed in said low pressure cylinder, and (4) a high pressure plunger slidably disposed in said high pressure cylinder;

B. intensifying the pressure of said fuel in said high pressure cylinder by supplying pressurized liquid to said low pressure cylinder from said source of pressurized liquid, thereby causing said piston to drive said plunger downwardly in said high pressure cylinder;

C. injecting fuel from said injector nozzle at a pressure which is no higher than the intensified pressure in said high pressure cylinder; and D. only in the event of injector nozzle failure, blocking said inlet port via downward movement of said plunger to an overtravel position and preventing further fuel flow through said high pressure cylinder, thereby preventing further and uncontrolled injection events.

15. A method as defined in claim 14, further comprising forcing fuel from said high pressure cylinder into an accumulator chamber prior to said step (D), and wherein during normal operation of said fuel injector, said plunger moves downwardly during each normal intensification stroke to a normal lowermost position (1) which is defined by a balanced fuel pressure in said accumulator chamber and said high pressure cylinder below said plunger, and (2) in which said inlet port remains uncovered by said plunger to permit fuel to flow into said high pressure cylinder, and in the event of injector nozzle failure, reduced balancing pressure in said accumulator chamber allows said plunger to move below said normal lowermost position to an overtravel position in which said plunger blocks said inlet port, thereby preventing fuel flow through said high pressure cylinder and preventing further and uncontrolled injection events.

16. A method as defined in claim 14, further comprising limiting the extent of overtravel of said plunger so that the bottom of said plunger remains above the bottom of said high pressure cylinder in said overtravel position of said plunger.

* * * * *

UNITED STATES PATENT AND TRADEMARK OFFICE

CERTIFICATE OF CORRECTION

PATENT NO. : 5,537,972
DATED : July 23, 1996
INVENTOR(S) : Beck, et. al.

It is certified that error appears in the above-indentified patent and that said Letters Patent is hereby corrected as shown below:

Title page, item [63], insert the following: Related U.S. Application Data-- Continuation of PCT/US92/05227, jun. 25, 1992.--

Signed and Sealed this

Nineteenth Day of November, 1996

*Attest:*

Bruce Lehman

BRUCE LEHMAN

*Attesting Officer*

*Commissioner of Patents and Trademarks*